US006583347B2

(12) United States Patent
Tamura

(10) Patent No.: US 6,583,347 B2
(45) Date of Patent: Jun. 24, 2003

(54) METHOD OF SYNTHESIZING MUSICAL TONE BY EXECUTING CONTROL PROGRAMS AND MUSIC PROGRAMS

(75) Inventor: Motoichi Tamura, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 176 days.

(21) Appl. No.: 09/853,069

(22) Filed: Dec. 8, 2000

(65) Prior Publication Data

US 2002/0134217 A1 Sep. 26, 2002

Related U.S. Application Data

(62) Division of application No. 09/306,551, filed on May 6, 1999, now Pat. No. 6,180,863.

(30) Foreign Application Priority Data

May 15, 1998 (JP) ..... 10-133761

(51) Int. Cl.[7] ..... G10H 7/00
(52) U.S. Cl. ..... 84/603; 84/622; 84/633
(58) Field of Search ..... 84/600–604, 609, 84/622–626, 633, 659–660, 662, 665

(56) References Cited

U.S. PATENT DOCUMENTS 5,696,342 A 12/1997 Shimizu
5,728,961 A 3/1998 Tamura
5,750,911 A 5/1998 Tamura
5,770,812 A * 6/1998 Kitayama ..... 84/603
5,955,691 A * 9/1999 Suzuki et al. ..... 84/604
6,023,016 A * 2/2000 Tamura ..... 84/604
6,064,743 A * 5/2000 Suggs ..... 84/633

* cited by examiner

*Primary Examiner*—Marlon T. Fletcher
(74) *Attorney, Agent, or Firm*—Morrison & Foerster LLP

(57) ABSTRACT

A music apparatus has a central processor, a plurality of generator modules, and a program memory storing instructions for causing the central processor to execute a process of synthesizing a musical tone signal with the generator modules. The process includes the steps of commanding each of the generator modules to generate a predetermined number of samples of the musical tone signal at a common sampling period, and collecting the samples from each of the generator modules and processing the collected samples at the common sampling period to thereby synthesize the musical tone signal. The generator modules include a synchronous generator module that does generate the predetermined number of the samples at the common sampling period, and an asynchronous generator module that does not generate the predetermined number of the samples at the common sampling period. The asynchronous generator module is commanded to perform the steps of generating an equivalent number of samples at a local sampling period, and converting the equivalent number of the samples arranged at the local sampling period into the predetermined number of the samples arranged at the common sampling period to thereby pass the predetermined number of the samples to the collecting step at the common sampling period.

24 Claims, 17 Drawing Sheets

FIG.13(A)

TGM REGISTRATION DATA

| |
|---|
| NUMBER OF TONE GENERATOR MODULES (=5) |
| TGM1 DATA |
| TGM2 DATA |
| TGM3 DATA |
| TGM4 DATA |
| TGM5 DATA |
| — |
| — |

FIG.13(B)

EFM REGISTRATION DATA

| |
|---|
| NUMBER OF EFFECT MODULES (=4) |
| EFM1 DATA |
| EFM2 DATA |
| EFM3 DATA |
| EFM4 DATA |
| — |
| — |
| — |

FIG.13(C)

COMMON DATA

| |
|---|
| SFS |
| OFS |
| T-SEQUENCE DATA |
| MAX |

FIG.13(D)

PART DATA

| |
|---|
| PD1 |
| PD2 |
| PD3 |
| ⋮ |
| PD16 |
| INSERTION DATA |

| |
|---|
| TMN3 |
| TFS3 (Fs) |
| TPN3 (TIMBRE) |
| MT3 (NUMBER OF TONES) |
| PAN3 |
| DS3 |
| 1S3 |
| 2S3 |
| 3S3 |
| OTHER DATA |

FIG.13(E)

EFFECT DATA

| |
|---|
| E-SEQUENCE DATA |
| ED1 |
| ED2 |
| ED3 |

| |
|---|
| EMN2 |
| EPN2 |
| EDS2 |
| E1S2 |
| E3S2 |
| OTHER DATA |

METHOD OF SYNTHESIZING MUSICAL TONE BY EXECUTING CONTROL PROGRAMS AND MUSIC PROGRAMS

This is a divisional of application Ser. No. 09/306,551, filed May 6, 1999, now U.S. Pat. No. 6,180,863, which is incorporated by reference in its entirety.

BACKGROUND OF THE INVENTION

1. Field of the Invention

The present invention generally relates to a tone synthesizing method, a tone processing method, and a tone synthesizing apparatus that is suitable for use in the tone synthesis based on software.

2. Description of Related Art

Various software programs are known for tone synthesis on computer systems. In these software programs, various tone generator modules such as FM tone generator, PCM tone generator, and physical model tone generator are provided, and tones synthesized by these modules are mixed together, thereby providing a desired tone signal.

The above-mentioned tone synthesizing technology requires to set the sampling frequencies of various modules to a common level. This makes it difficult to adopt those modules (for example, the physical model tone generator) which hardly operate with sampling frequencies other than specific one. This prohibits users to use high-quality modules only because of discrepancy in sampling frequencies. Consequently, it has been difficult to acrieve high-quality tone synthesis.

Further, if CPU power runs short in software-based tone synthesis, some countermeasures must be taken, such as partially skipping the tone synthesis processing for example. However, the conventional software cannot properly determine which part of the processing is to be skipped. This may inadvertently skip an essential processing operation, thereby significantly lowering the tone quality.

Still further, the conventional software-based tone synthesis frequently executes processing in some collective units (called a frame) because it is inefficient to execute the processing on a sample by sample basis. However, in imparting two or more sound effects in this frame-based processing, an improper imparting sequence may not provide sufficient sound effects. The sequence of applying the different effects is not considered in the conventional tone synthesizing software, thereby degrading the quality of synthesized tones.

SUMMARY OF THE INVENTION

It is therefore an object of the present invention to provide a tone synthesizing method, a tone processing method, and a tone synthesizing apparatus, that synthesize quality tones based on software.

In a first aspect, an inventive method is designed for synthesizing a musical tone signal by executing a control program and a plurality of generator programs with a processor. The control program is executed to perform the steps of commanding each of the generator programs to generate a predetermined number of samples of the musical tone signal at a first sampling period, and collecting the samples from each of the generator programs and processing the collected samples at the first sampling period to thereby synthesize the musical tone signal. The generator programs include a synchronous generator program that does generate the predetermined number of the samples at the first sampling period, and an asynchronous generator program that does not generate the predetermined number of the samples at the first sampling period. The asynchronous generator program is executed to perform the steps of generating an equivalent number of samples at a second sampling period in response to the commanding from the control program, the equivalent number of the samples arranged at the second sampling period being determined to correspond to the predetermined number of the samples arranged at the first sampling period, and converting the equivalent number of the samples arranged at the second sampling period into the predetermined number of the samples arranged at the first sampling period to thereby pass the predetermined number of the samples to the control program at the first sampling period.

In a second aspect, an inventive method of synthesizing a musical tone signal comprises the steps of designating a first sampling period to determine a rate of synthesis of the musical tone signal, adopting a second samplings period from among a plurality of available sampling periods according to the designated first sampling period, generating the musical tone signal at the adopted second sampling period, converting the generated musical tone signal from the adopted second sampling period into the designated first sampling period when the second sampling period is different from the first sampling period to output the converted musical tone signal at the designated first sampling period, otherwise outputting the generated musical tone signal as it is when the adopted second sampling period is identical to the designated first sampling period., and processing the outputted musical tone signal at the designated first sampling period for the synthesis of the musical tone signal.

In a third aspect of the invention, a method of synthesizing a musical tone signal comprises the steps of commanding a generation of a predetermined number of samples of the musical tone signal at a first sampling period such that the predetermined number of the samples are sequentially arranged at the first sampling period, the generation being commanded recurrently to continue the musical tone signal, generating a practical number of samples of the musical tone signal in response to the commanding at a second sampling period which is different from the first sampling period, the practical number being determined to make efficient the generation of the musical tone signal and to cover the predetermined number of the samples, collecting a number of samples generated but unprocessed in a previous generating step and reserved in a memory, and a part of the practical number of the samples generated in the current generating step such that a total number of the collected samples is equivalent to the predetermined number of the samples, converting the collected number of the samples arranged at the second sampling period into the predetermined number of the samples arranged at the first sampling period to output the musical tone signal, and reserving the remaining part of the practical number of the samples generated but left in the current generating step into the memory for use in a next generating step.

In a fourth aspect of the invention, a method of synthesizing a musical tone signal comprises the steps of commanding a generation of a predetermined number of samples of the musical tone signal, the generation being commanded recurrently to continue the musical tone signal, generating a practical number of samples of the musical tone signal in response to the commanding, the practical number being determined to make efficient the generation of the musical tone signal and to cover the predetermined number of the samples, collecting a number of samples generated but unprocessed in a previous generating step and reserved in a memory, and a part of the practical number of the samples generated in the current generating step such that a total number of the collected samples is equivalent to the predetermined number of the samples, processing the collected number of the samples to synthesize the musical tone signal, and reserving the remaining part of the practical number of the samples generated but unprocessed in the current generating step into the memory for use in a next generating step.

In a fifth aspect, an inventive method is designed for synthesizing a musical tone signal by using a processor to sequentially execute a plurality of tone generator modules including a flexible one capable of altering a mode of generating a musical tone, and an inflexible one not capable of altering a mode of generating a musical tone. The inventive method comprises the steps of determining a sequence in the executing of the plurality of the tone generator modules such that the inflexible one precedes to the flexible one, executing the plurality of the tone generator modules in the determined sequence by the processor having a variable working load to generate the musical tones, controlling the flexible one to alter the mode of generating the musical tone dependently on the working load of the processor after the inflexible one has been executed in precedence to the flexible one, and mixing the musical tones generated from the plurality of the tone generator modules to synthesize the musical tone signal. Preferably, the inflexible one is capable of generating a fixed number of musical tones at once, and the flexible one is capable of generating a variable number of the musical tones at once such that the flexible one is controlled to alter the variable number of the musical tones dependently on the working load of the processor. Preferably, the flexible one is capable of altering a computation amount consumed to generate a musical tone, and the inflexible one is not capable of altering the computation amount such that the flexible one is controlled to alter the computation amount dependently on the working load of the processor.

In a sixth aspect, an inventive method is designed for processing a musical tone signal by sequentially executing a plurality of signal processing modules to impart corresponding effects to the musical tone signal. The inventive method comprises the steps of designating connections among the plurality of the signal processing modules, determining the sequence in the executing of the plurality of the signal processing modules according to the designated connections, generating a fragment of the musical tone signal at a predetermined interval, executing the plurality of the signal processing modules in the determined sequence at each predetermined interval to impart the corresponding effects to the fragment of the musical tone signal such that the fragment of the musical tone signal processed by a preceding signal processing module is passed to a succeeding signal processing module according to the designated connections, and mixing the fragments processed by the plurality of the signal processing modules to synthesize the musical tone signal.

In a seventh aspect, an inventive method is designed for synthesizing a musical tone signal by executing a control program and a plurality of music programs and by using a multiple of buffer memories. The control program is executed to perform the steps of commanding a sequential execution of the plurality of the music programs to sequentially process the musical tone signal, and passing the musical tone signal among the music programs by means of the buffer memories during the sequential execution of the music programs. The plurality of the music programs are executed to perform the steps of generating the musical tone signal and storing the musical tone signal in the buffer memories in response to the commanding step, processing the musical tone signal stored in the buffer memories in response to the commanding step, controlling a volume of the musical tone signal which is outputted by either of the generating step and the processing step, and accumulating the musical tone signal having the controlled volume into at least one of the buffer memories for synthesis of the musical tone signal.

BRIEF DESCRIPTION OF THE DRAWINGS

These and other objects of the invention will be seen by reference to the description, taken in connection with the accompanying drawings, in which:

FIG. 13(A) is a diagram illustrating a structure of TGM registration data;

FIG. 13(B) is a diagram illustrating a structure of EFM registration data;

FIG. 13(C) is a diagram illustrating a structure of common data;

FIG. 13(D) is a diagram illustrating a structure of part data;

FIG. 13(E) is a diagram illustrating a structure of effect data;

DETAILED DESCRIPTION OF PREFERRED EMBODIMENTS

This invention will be described in further detail by way of example with reference to the accompanying drawings.

1. Hardware Configuration of the Embodiment

Figure 3:
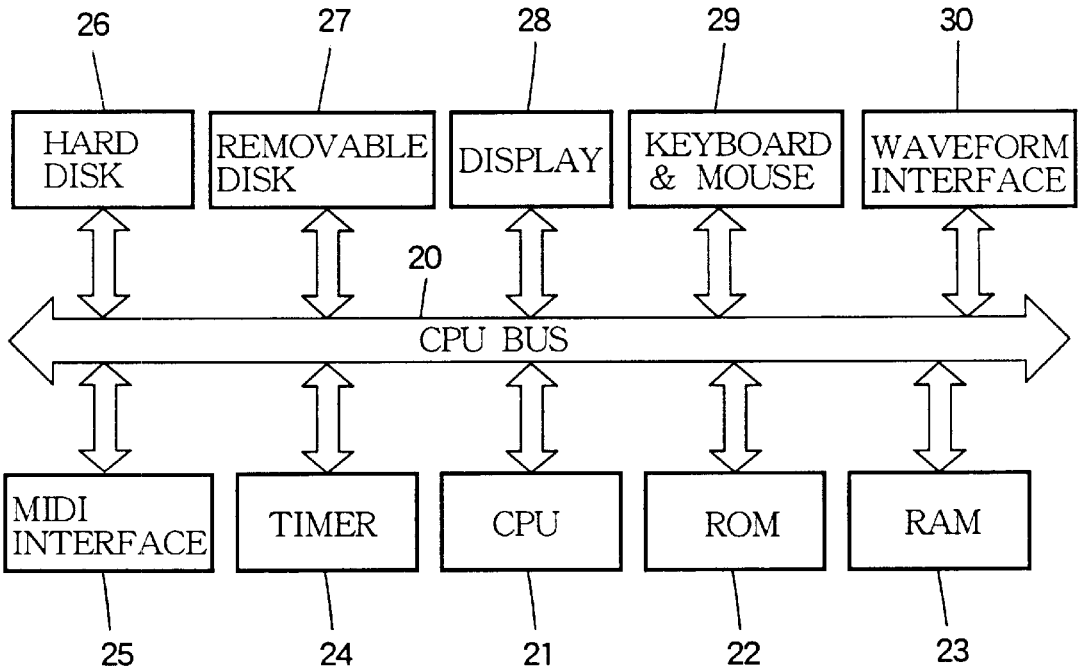
FIG. 3 is a block diagram illustrating a hardware configuration of the preferred embodiment shown in FIG. 1.

The following describes a hardware configuration of one preferred embodiment of the present invention with reference to FIG. 3. In the figure, reference numeral 21 denotes a CPU (Central Processing Unit) for controlling other components of the embodiment through a CPU bus 20 as instructed by a control program. Reference numeral 22 denotes a ROM (Read Only Memory) storing an initial program loader for example. Reference numeral 23 denotes a RAM (Random Access Memory) into which various programs and data are loaded for access by the CPU 21. Reference numeral 24 denotes a timer for generating an interrupt for the CPU 21 with a predetermined timing.

Reference numeral 25 denotes a MIDI interface (Musical Instrument Digital Interface) for transferring MIDI signals to and from an external MIDI device (not shown). Reference numeral 26 denotes a hard disk storing various device drivers, various application programs, and various items of performance information. Reference numeral 27 denotes a removable disk, which is a CD-ROM or an MO (Magneto Optical) disk storing items similar to those stored on the hard disk 26.

Reference numeral 28 denotes a display, which is constituted by a CRT (Cathode Ray Tube) display or a LCD (Liquid Crystal Device) display for displaying various items of information. Reference numeral 29 denotes a keyboard and mouse, through which the user enters various items of information into the CPU 21. Reference numeral 30 denotes a waveform interface for interfacing analog signal waveforms.

Figure 4:
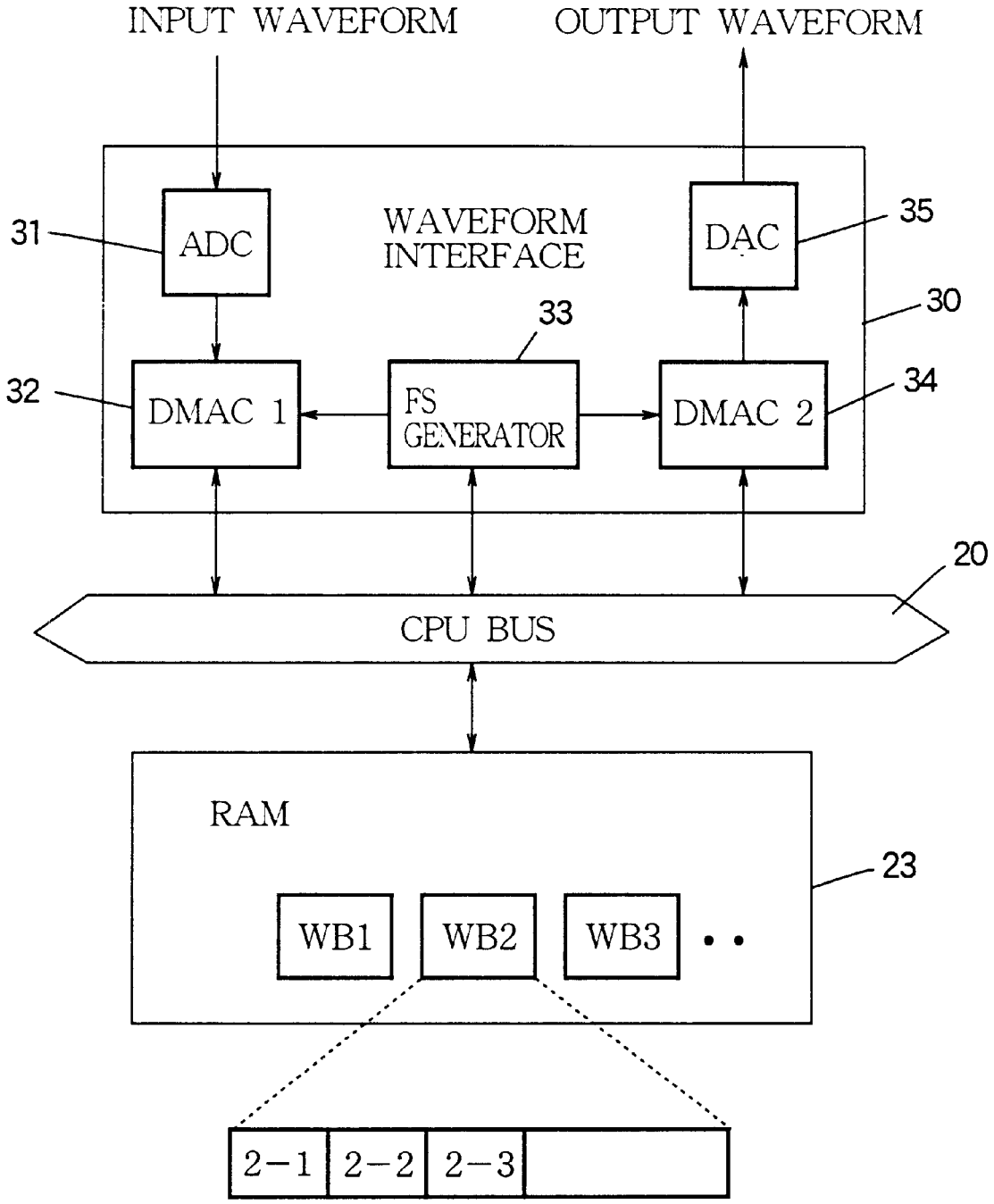
FIG. 4 is a schematic diagram illustrating a waveform interface used in the preferred embodiment shown in FIG. 1.

The following describes the details of the waveform interface 30 with reference to FIG. 4. In the figure, reference numeral 31 denotes an AD (Analog-to-Digital) converter for converting an inputted analog signal into a digital signal. Reference numeral 33 denotes a sampling clock generator for generating a clock signal having a predetermined sampling frequency. Reference numeral 32 denotes a first DMA (Direct Memory Access) controller for sampling an output signal of the AD converter 31 in synchronization with the clock signal, thereby transferring the sampled signal to a specified location in the RAM 23 in the manner of direct memory access.

Reference numeral 34 denotes a second DMA controller for reading, in the manner of direct memory access, digital waveform data from the RAM 23 in synchronization with the clock signal outputted from the sampling clock generator 33. Reference numeral 35 denotes a DA (Digital-to-Analog) converter for converting the digital waveform data read from the RAM 23 into an analog signal.

Figure 1:
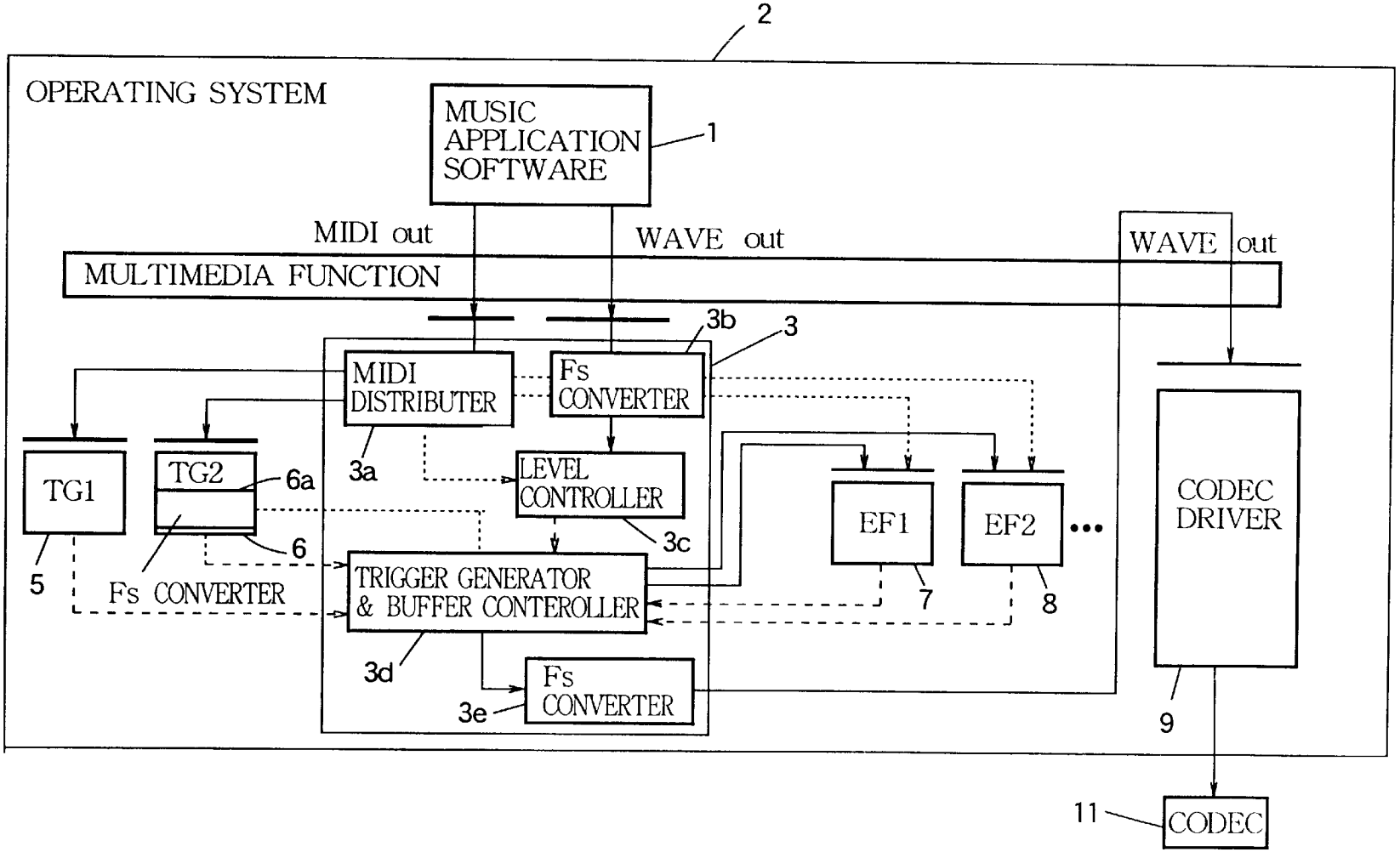
FIG. 1 is a block diagram illustrating a software configuration of one preferred embodiment of the invention.

2. Software Configuration of the Embodiment 2.1 Overall Configuration of Software The following describes a software configuration of the above-mentioned preferred embodiment with reference to FIG. 1. In the figure, reference numeral 2 denotes an operating system. Application programs and various drivers execute input/output processing with aid of the API (Application Program Interface) provided in the operating system in the form of a multimedia function. Reference numeral 1 denotes a music application software, one of the application programs.

The music application software 1 generates a MIDI-Out or WAVE-Out message when it becomes necessary to generate a tone. The MIDI-Out message outputs a tone signal as a MIDI signal. The WAVE-Out message outputs a tone signal as waveform data.

Reference numerals 5, 6, and so on denote tone generator modules such as FM tone generator, PCM tone generator, and physical model tone generator, which generate waveform data based on supplied MIDI signals. If a local sampling frequency TFs for use in the waveform data generation is different from a predetermined system sampling frequency SFs, the local waveform data sampling frequency TFs is converted to the system sampling frequency SFs. For example, the tone generator module 6 has an Fs converting block 6*a* for executing that conversion. If the local sampling frequency TFs is equal to the system sampling frequency SFs, the conversion is not required.

Typical sampling frequencies include 44.2 KHz, which is the sampling frequency for CD (Compact Disc), 22.1 KHz, which is a half of the CD sampling frequency, 32 KHz, 48 KHz, and so on. Reference numerals 7, 8, and so on denote effect modules for imparting effects such as reverberation and chorus to the supplied waveform data, based on effect algorithms unique to the effect modules. Reference numeral 3 denotes an integrated driver for controlling the tone generator modules 5, 6, and so on and the effect modules 7, 8, and so on, based on the above-mentioned MIDI-Out and WAVE-Out messages.

To be more specific, a MIDI signal supplied by a MIDI-Out port is distributed through a MIDI distribution block 3*a* to the tone generator module corresponding to the part represented by the MIDI signal. Receiving the MIDI signal, the tone generator module generates appropriate waveform data. To implement this operation, each tone generator module has a MIDI signal input buffer called an M buffer. The integrated driver 3 writes the content of a MIDI event to the M buffer of the corresponding tone generator module.

Reference 3*b* denotes a sampling frequency converting block. If the sampling frequency Fs of waveform data supplied through a WAVE-Out port is different from the system sampling frequency SFs, the sampling frequency converting block 3*b* converts the sampling frequency Fs into the system sampling frequency SFs and writes the converted results to a predetermined buffer area. Incidentally, the waveform data outputted from the tone generator modules 5, 6, and so on and the effect modules 7, 8, and so on are all accumulated to that predetermined buffer area. Reference 3*d* denotes a trigger generating and buffer control block for monitoring whether the buffer update operations have been completed or not. If the buffer update operations are completed, the buffer control block 3*d* generates a trigger for a next stage. The waveform data stored in the above-mentioned predetermined buffer area is inputted in the corresponding effect module or an Fs converting block 3*e* .

Reference numeral 11 denotes a CODEC (COder/DECoder) block, which is implemented by the waveform interface 30. Reference numeral 9 denotes a CODEC driver for driving the CODEC block 11. If the sampling frequency of the waveform data obtained through the trigger generating and buffer control block 3*d* (namely, the system sampling frequency SFs) is different from the output sampling frequency OFs of the CODEC block 11, the Fs converting block 3*e* in the integrated driver 3 converts the sampling frequency of that waveform data into the output sampling frequency OFs and outputs the converted results through a WAVE-Out to the CODEC driver 9.

2.2 Fs Converting Blocks

Figure 2:
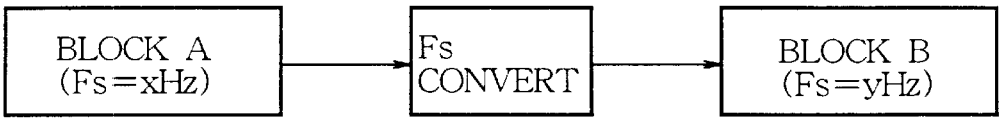
FIG. 2 is a schematic diagram illustrating an operation of the preferred embodiment shown in FIG. 1.

The Fs converting blocks 3*b* , 3*e* , and 6*a* are generally represented as shown in FIG. 2. To be more specific, each Fs converting block receives waveform data from a preceding block A, which operates at Fs=x Hz, converts the sampling frequency of the received waveform into Fs=y Hz, and supplies the same to a succeeding block B. These Fs converting operations depend on the relationship in a rate between the sampling frequency x and the sampling frequency y.

If x>y, low-pass filtering is executed on the waveform data with y/2 Hz used as cutoff frequency. As a result, the sample value of each sampling point of the sampling frequency y is computed. If the sampling point in the waveform data outputted from the block A matches the sampling point of the sampling frequency y, a sampling value is computed likewise.

On the other hand, if x<y, low-pass filtering is executed on the waveform data with x/2 Hz used as cutoff frequency. As a result, the sample value of each sampling point of the sampling frequency y is computed. Sample value computation is not executed where the sampling point of the waveform data outputted from the block A matches the sampling point of the sampling frequency y. In this case, the value outputted from the block A is used without change. Thus, regardless whether x>y or x<y, the waveform data of the sampling frequency x can be converted into the waveform data of the sampling frequency y while suppressing aliening noise.

Referring back to FIGS. 1 and 3, according to the first aspect of the invention, the inventive music apparatus is composed of a central processor in the form of the CPU 21, a plurality of generator modules including TG1, TG2 and so on, and a program memory such as ROM 23 and RAM 22 storing instructions for causing the central processor to execute a process of synthesizing a musical tone signal with the generator modules. The process comprises the steps of commanding each of the generator modules 5,6 and so on to generate a predetermined number of samples of the musical tone signal at a common sampling period, or system sampling period and collecting the samples from each of the generator modules and processing the collected samples at the common sampling period to thereby synthesize the musical tone signal. The generator modules include a synchronous generator module that does generate the predetermined number of the samples at the common sampling period, and an asynchronous generator module that does not generate the predetermined number of the samples at the common sampling period. The asynchronous generator module is commanded to perform the steps of generating an equivalent number of samples at a local sampling period, the equivalent number of the samples arranged at the local sample period being determined to correspond to the predetermined number of the samples arranged at the common sampling period, and converting the equivalent number of the samples arranged at the local sampling period into the predetermined number of the samples arranged at the common sampling period by means of the FS converter 6*a* to thereby pass the predetermined number of the samples to the collecting step at the common sampling period.

According to the second aspect of the invention, the inventive music apparatus is composed of a central processor in the form of CPU 21, and a program memory such as ROM 23 and RAM 22 storing instructions for causing the central processor to execute a process of synthesizing a musical tone signal. The process is executed by the steps of designating a common sampling period to determine a rate of synthesis of the musical tone signal, adopting a local sampling period from among a plurality of available sampling periods according to the designated common sampling period, generating the musical tone signal at the adopted local sampling period, converting the generated musical tone signal from the adopted local sampling period into the designated common sampling period when the local sampling period is different from the common sampling period to output the converted musical tone signal at the designated common sampling period, otherwise outputting the generated musical tone signal as it is when the adopted local sampling period is identical to the designated common sampling period, and processing the outputted musical tone signal at the designated common sampling period for the synthesis of the musical tone signal.

According to the third aspect of the invention, the music apparatus is composed of a central processor in the form of CPU 21, a buffer memory provided in a part of RAM 23, and a program memory such as ROM 22 storing instructions for causing the central processor to execute a process of synthesizing a musical tone signal. The process is executed by the steps of commanding a generation of a predetermined number of samples of the musical tone signal at a common sampling period such that the predetermined number of the samples are sequentially arranged at the common sampling period, the generation being commanded recurrently to continue the musical tone signal, generating a practical number of samples of the musical tone signal in response to the commanding at a local sampling period which is different from the common sampling period, the practical number being determined to make efficient the generation of the musical tone signal and to cover the predetermined number of the samples, collecting a number of samples generated but unprocessed in a previous generating step and reserved in the buffer memory, and a part of the practical number of the samples generated in the current generating step such that a total number of the collected samples is equivalent to the predetermined number of the samples, converting the collected number of the samples arranged at the local sampling period into the predetermined number of the samples arranged at the common sampling period to output the musical tone signal, and reserving the remaining part of the practical number of the samples generated but left in the current generating step into the buffer memory for use in a next generating step.

3. Data Structures of the Embodiment

The following describes various data structures used in the above-mentioned embodiment with reference to FIGS. 13(A) through 13(E). FIG. 13(A) illustrates TGM registration data associated with tone generator modules. The number of registered tone generator modules is recorded on top of the table, sequentially followed by the TGM registration data unique to each tone generator module. The TGM registration data contains data such as module names (for example a brass instrument model) for specifying the tone generator modules.

FIG. 13(B) illustrates EFM registration data associated with effect modules. The number of registered effect modules is recorded on top of the table, sequentially followed by data such as module names for specifying the effect modules.

FIG. 13(C) illustrates common data for common use by the above-mentioned modules. The above-mentioned system sampling frequency SFs and the output sampling frequency OFs are included in this common data. T-sequence data determines a sequence in which each tone generator module is executed. MAX specifies the upper limit of the load of the CPU 21, which may be determined automatically by a benchmark test for example or manually by a user.

FIG. 13(D) illustrates part data including parameters for a maximum of 16 parts to be implemented by the tone generator modules and parameters associated with insertion effects. An insertion effect denotes an effect to be inserted in a part. Other effects, namely those to be imparted to a result of mixing two or more parts are referred to as system effects. Each part data PDn (n=1 to 16) has a tone module number TMN (alternatively a module name) indicative of the number of a corresponding tone generator module, the local sampling frequency TFs of a part in question, a timbre number TPN, and the maximum number of tones MT. The tone module number TMN selectively specifies one of the tone generator modules registered in the TGM registration data shown in FIG. 13(A).

PAN denotes a panning level. DS, 1S, 2S, and 3S denote send levels. The meanings of these levels will be described later. The insertion data includes a module number EMN (alternatively, a module name) indicative of an effect module for imparting an insertion effect, a part number of a part to which the insertion effect is imparted, and a parameter number for specifying a parameter for the effect processing. Two insertion effects may be set independently of each other. Each is executed, by an effect module specified by module number EMN and with use of a parameter specified by parameter number, on the tone signal of a part specified by the part number. If two insertion effects are set to one part, one is applied at the preceding stage while the other is applied at the succeeding stage. If none is imparted to a particular part, part number 0 is set to that part. For the module number EMN, one of the effect modules registered in the EFM registration data shown in FIG. 13(B) is selectively specified.

FIG. 13(E) illustrates effect data. The effect data is constituted by E-sequence data and three blocks of effect data EDn (n=1 to 3) by which the system effect is constituted. The E-sequence data determines a system effect execution sequence. In the effect data EDn of block h, EMNn denotes the module number (alternatively, the module name) of an effect module for executing the effect processing, and EPNn denotes the parameter number for specifying a parameter, used for the effect processing. EDSn through E3Sn denote send levels.

4. Operation of the Embodiment 4.1 Integrated Driver Main Routine

Figure 5:
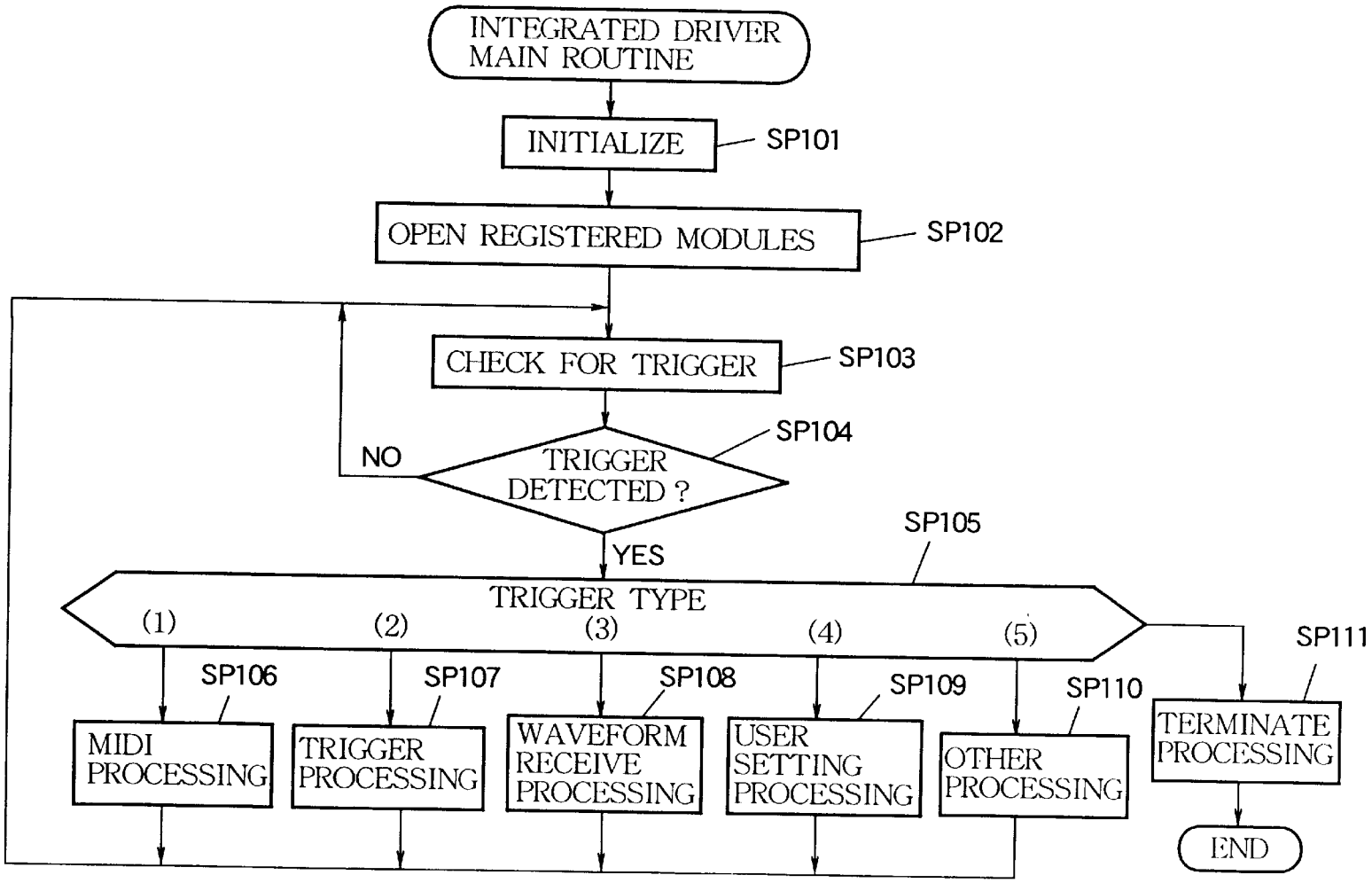
FIG. 5 is a flowchart showing an integrated driver main routine.

In operation, when the operating system 2 is started, the integrated driver 3 operates for executing an integrated driver main routine shown in FIG. 5. In step SP101, a predetermined initializing operation is executed. In the initialization, the T-sequence data indicative of a sequence by which two or more registered tone generator modules are sequentially executed is automatically determined. The determination is made by classifying the tone generator modules into those capable of wave-synthesizing two or more parts and others, the former being preferred in the synthesis.

Further, the tone generator modules are classified into those capable of changing a local sampling frequency and others, the former being preferred. In each group thus classified, those requiring larger CPU computations for generating one tone are preferred. This lowers the preference of the tone generator modules capable of modifying the computation for the tone generation, thereby making the load of the CPU 21 adjustable by those tone generator modules. Details of this point will be described later. It should be noted that the T-sequence data may also be manually modified any time.

In step SP102, each registered module is opened. In step SP103, it is determined whether a trigger has occurred. The trigger is any of the following:

(1) inputting of a MIDI-Out message from the music application software 1;

(2) inputting of a trigger message from the operating system 2;

(3) reception of waveform data from a module;

(4) inputting of user settings through the keyboard & mouse 29;

(5) inputting of an end message from the operating system 2; and (6) inputting of other various messages.

In steps SP103 and SP104, the processing is kept in a wait state until any of these triggers is detected. When the trigger is detected, the corresponding processing is executed in step SP105. If the detected trigger is the inputting of an end message, the integrated driver 3 is terminated in step SP111. If another trigger is detected, corresponding processing is executed accordingly, after which the processing returns to step SP103. The following describes the details of the processing to be executed in response to the above-mentioned triggers.

4.2 Inputting of User Setting 4.2.1 Registering a Tone Module

Figure 8:
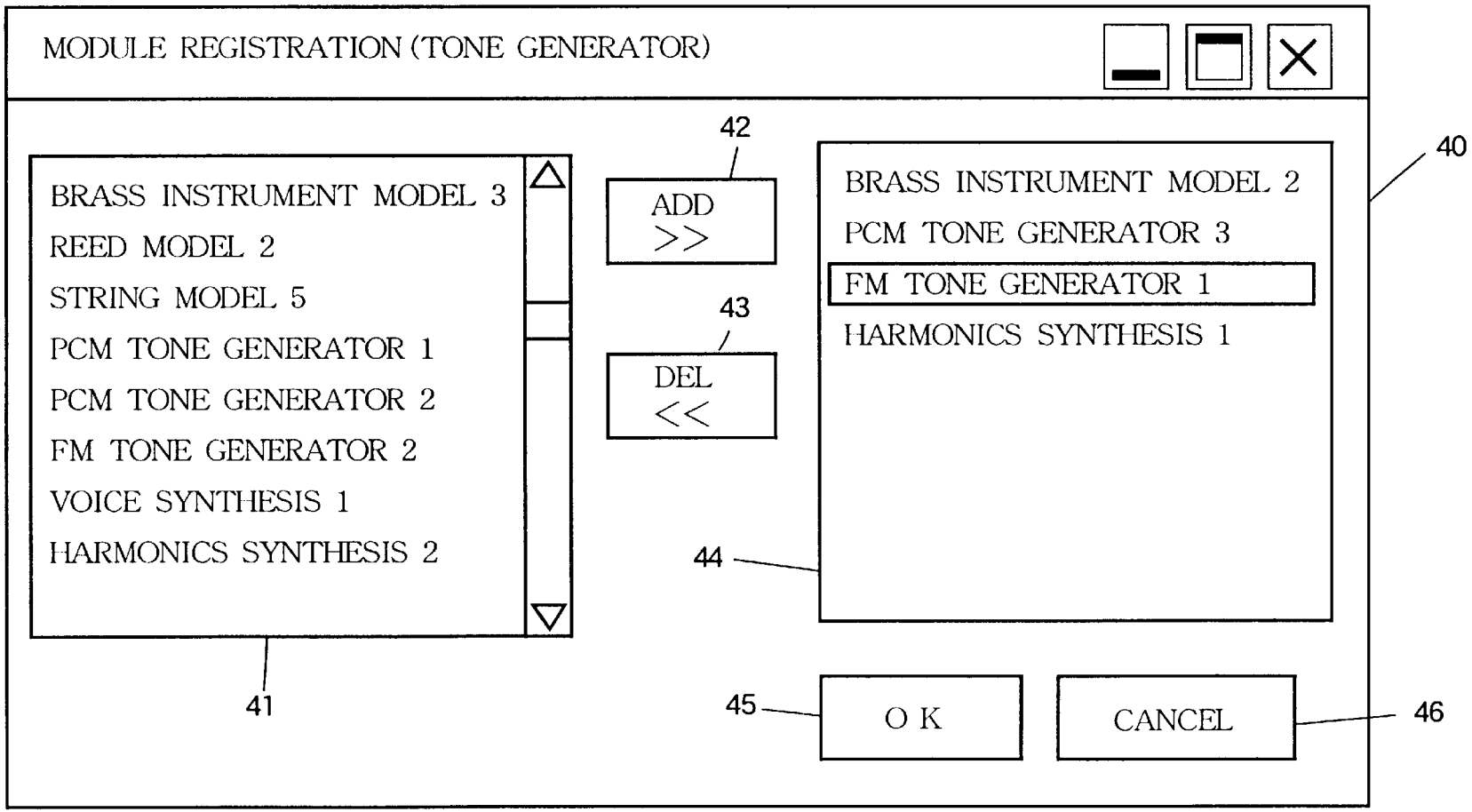
FIG. 8 is a schematic diagram illustrating a tone generator module registration window displayed on a display shown in FIG. 3.

When the user operates the keyboard or the mouse, the operation is detected in step SP103. Then, in step SP109, through steps SP104 and SP105, various settings may be executed for the integrated driver 3. When the user executes a predetermined operation, a tone module registration window 40 shown in FIG. 8 is displayed on the display 28. In the figure, reference numeral 41 denotes a module list box in which the module names of the registerable tone generator modules (installed on the hard disk 26 for example) are listed.

Reference numeral 44 denotes a registered module list box in which the module names of the tone generator modules registered in the integrated driver 3 are listed. Reference numeral 42 denotes an add button by which the user specifies registration of a new tone generator module. To be more specific, the user specifies (namely, by mouse clicking) any one of the module names in the module list box 41, and then clicks the add button 42. The selected tone generator module is added to the registered module list box 44. Then, the module names and the number of registered modules are stored in the TGM registration data shown in FIG. 13(A).

Reference numeral 43 denotes a delete button by which the user specifies deletion of a tone generator module listed in the registered module list box 44. To be more specific, when the user selects a tone generator module to be deleted in the registered module list box 44 and clicks the delete button, the selected tone generator module is deleted from the registered module list box 44. Namely, the module name of the deleted tone generator module is deleted from the TGM data shown in FIG. 13(A), and the number of registered modules is decremented by one. When, the user clicks an OK button 45, the new contents of the registered module list box 44 is confirmed. It should be noted that, when the user clicks a cancel button 46, the registered module in question is returned to the state as it was before displaying of the tone generator module registration window 40.

4.2.2 Setting a Part

Figure 9:
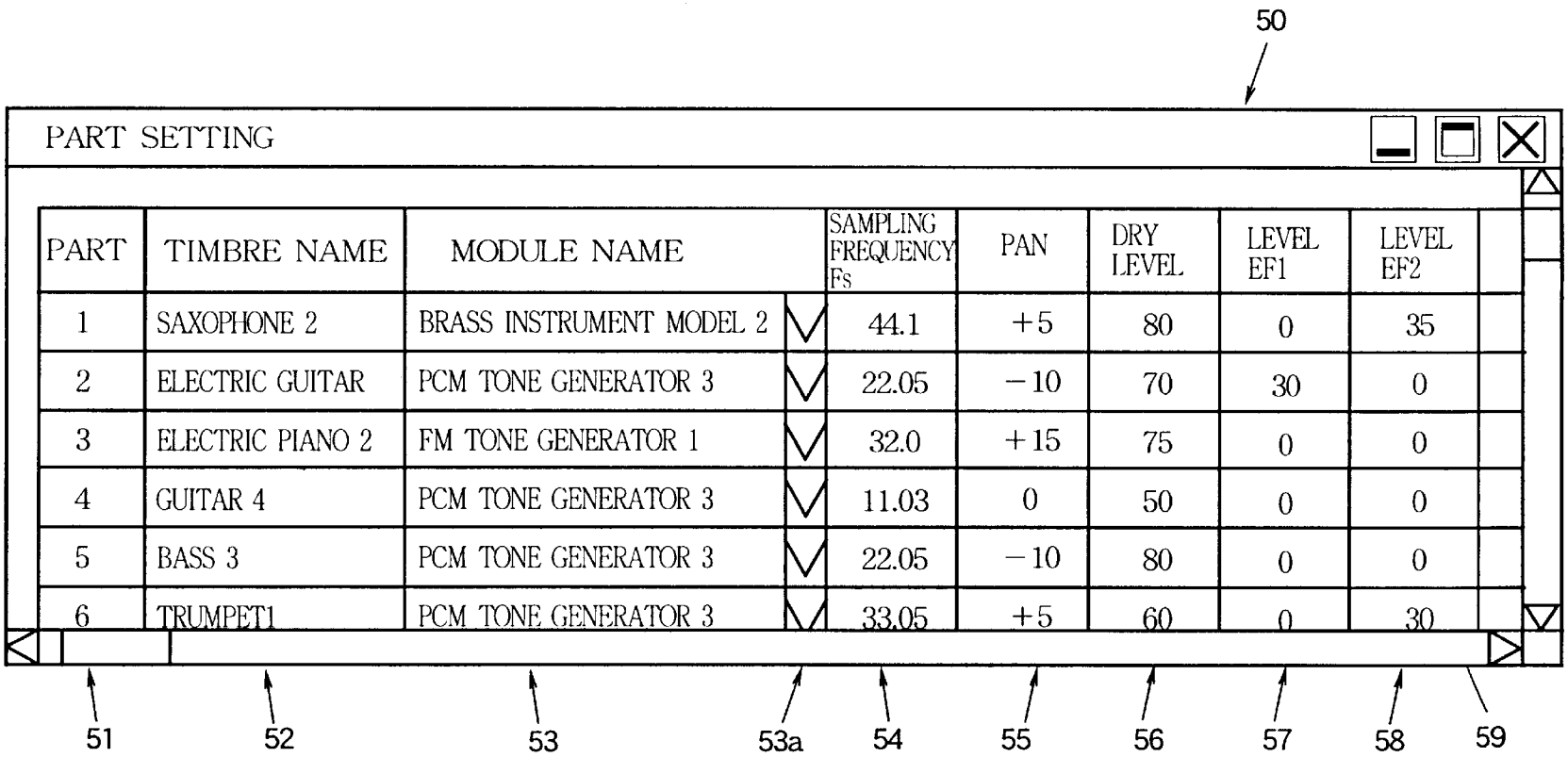
FIG. 9 is a schematic diagram illustrating a part setting window displayed on the display shown in FIG. 3.

When the user executes another predetermined operation, a part setting window 50 shown in FIG. 9 is displayed on the display 28. In the figure, reference numeral 51 denotes a part number display column in which part numbers 1 to 16 are displayed from top down. Reference numeral 52 denotes a timbre name display column in which timbre names assigned to parts are displayed. Reference numeral 53 denotes a module name display column in which the tone generator module names assigned to the parts are displayed.

Each module name display box 53 is a convolution box. When the user clicks a button 53*a* arranged at the right end, the list of the tone generator modules previously registered in the tone generator module registration window 40 is displayed on the display 28. When the user selects a desired tone generator module name from this list by mouse clicking, the selected tone generator module is set as a module to be assigned to the part in question. Then, the module number indicative of that module is stored as the TMN of that part as shown in FIG. 13(D).

When the user clicks the timbre name display column 52, the timbre name display column 52 changes to the convolution box, in which a list of the timbre names selectable in the tone generator modules displayed in the module name display column 53 is displayed. When the user clicks a desired timbre name, the selected timbre name is set as a timbre name to be assigned to the part in question. Then, the timbre number indicative of that timbre is stored as the TPN of that part as shown in FIG. 13(D).

Thus, the user can assign a desired timbre to each part by appropriately operating the module name display column 53 and the timbre name display column 52. Reference numeral 54 denotes a sampling frequency display column, in which the local sampling frequencies TFs of the parts are displayed. By executing an input operation in this display column, the user can set the local sampling frequency TFs of a part in question as shown in FIG. 13(D).

Meanwhile, the above-mentioned preferred embodiment has buffers WB1 through WB9 in the RAM 23 as shown in FIG. 4 to store waveform data. The waveform data generated in each tone generator module is multiplied by a send level and the resultant waveform data is stored in the buffers WB1 through WB7. The buffers WB1 and WB2 are used for stereo output for mixing tone signals finally outputted from the integrated driver 3. The buffers WB3 and WB4 are used for stereo input for mixing tone signals to be inputted in the first block EF1 of system effect. The buffers WB5 and WB6 are used for stereo input of the second block EF2of system effect. The buffer WB7 is used for monaural input of the third block EF3 of system effect. The buffers WB8 and WB9 are used for monaural input into the insertion effects IEF1 and IEF2, respectively.

Referring to FIG. 9, reference numeral 55 denotes a panning level edit box, in which the left and right level ratio in dB in the above-mentioned stereo output is displayed. Further, by positioning the cursor to the panning level edit box 55, the user can set a desired panning level by use of the keyboard for example. This holds true for the other edit boxes.

Reference numeral 56 denotes a dry level edit box, in which a send level DS indicative of the mean value of the send level to the buffers WB1 and WB2 is displayed and set. Reference numeral 57 denotes a first effect level edit box, in which a send level 1S indicative of the mean value of the send level to the buffers WB3 and WB4 is displayed and set. Reference numeral 58 denotes a second effect level edit box, in which a send level 2S indicative of the mean value of the send level to the buffers WB5 and WB6 is displayed and set. The DS, 1S, and 2S of each part shown in FIG. 13(D) denote the send levels thus set.

The send level to the buffers WB1 through WB6 is determined by the corresponding one of the above-mentioned send levels and the panning level. For example, if the first effect level 1S is 20 dB and the panning level is 10 dB, the send level to the buffer WB1 is 20+10=30 dB. The send level to the buffer WB2 is 20 −10=10 dB.

It should be noted that an edit box for setting a send level 3S to the buffer WB7 is provided for each part, but this edit box is not shown in the part setting window 50 in FIG. 9. This edit box can be displayed on the screen by operating a horizontal scroll bar 59 of the part setting window. It should be noted that, for the buffers WB8 and WB9, the level control by send is not executed. The above-mentioned values of panning level and send levels are for illustrative purposes only. Therefore, the user can set the values as desired.

4.2.3 Setting an Effect

The above-mentioned tone generator module registration window 40 and part setting window 50 are provided for setting or configuring the tone generator modules. When the user executes predetermined operations, like windows are displayed for effect module setting. Namely, the user can add or delete effect modules through an effect module registration window screen like the tone module registration window 40. The module names of registered effect modules and the number of registered effect modules are stored as the EFM registration data shown in FIG. 13(B). Through a system effect setting window like the part setting window 50, the user can set three blocks of effect data, namely each block's module number EMNn, parameter number EPNn, and send levels EDSn through E3Sn, which are stored in the storage areas of the blocks shown in FIG. 13(E). Likewise, through an insertion effect setting window, the user can set the module number EMN, part number, and parameter number of each of two insertion effects, which are stored as the insertion data shown in FIG. 13(D). Further, through a system setting window, the user can set the system sampling frequency SFs, output sampling frequency OFs, and CPU load upper limit MAX shown in FIG. 13(C). It should be noted that the effect data of each block of the system effect has no panning level that exists in the part data. The send level EDSn set in each block provides without change the send level common to the buffers WB1 and WB2. Likewise, E1Sn provides the send level to the buffers WB3 and WB4, E2Sn provides the send level to the buffers WB5 and WB6, and E3Sn provides the send level to the buffer WB7.

4.2.4 Tone Synthesizing System

Figure 6:
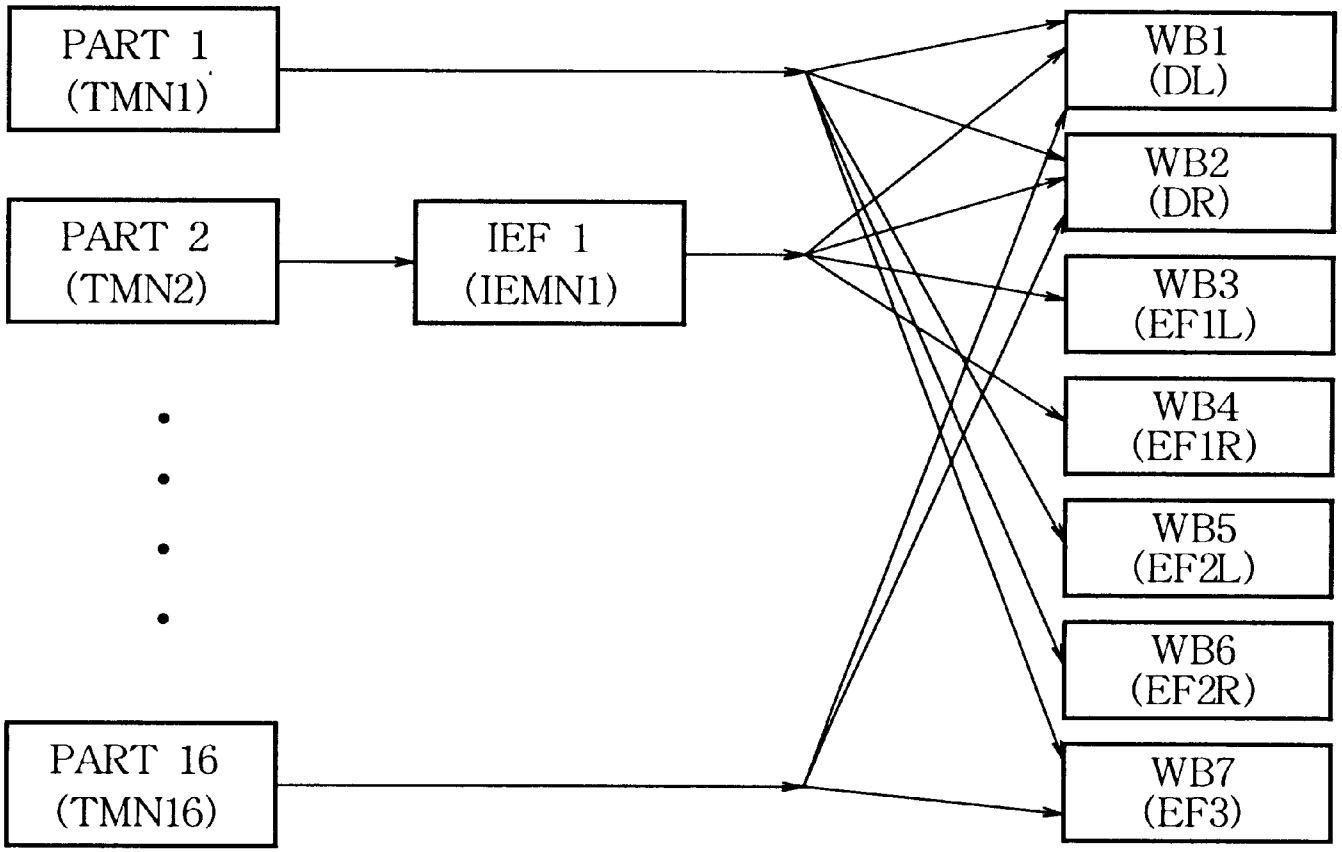
FIG. 6 is a diagram illustrating an operation of the preferred embodiment shown in FIG. 1.
Figure 7:
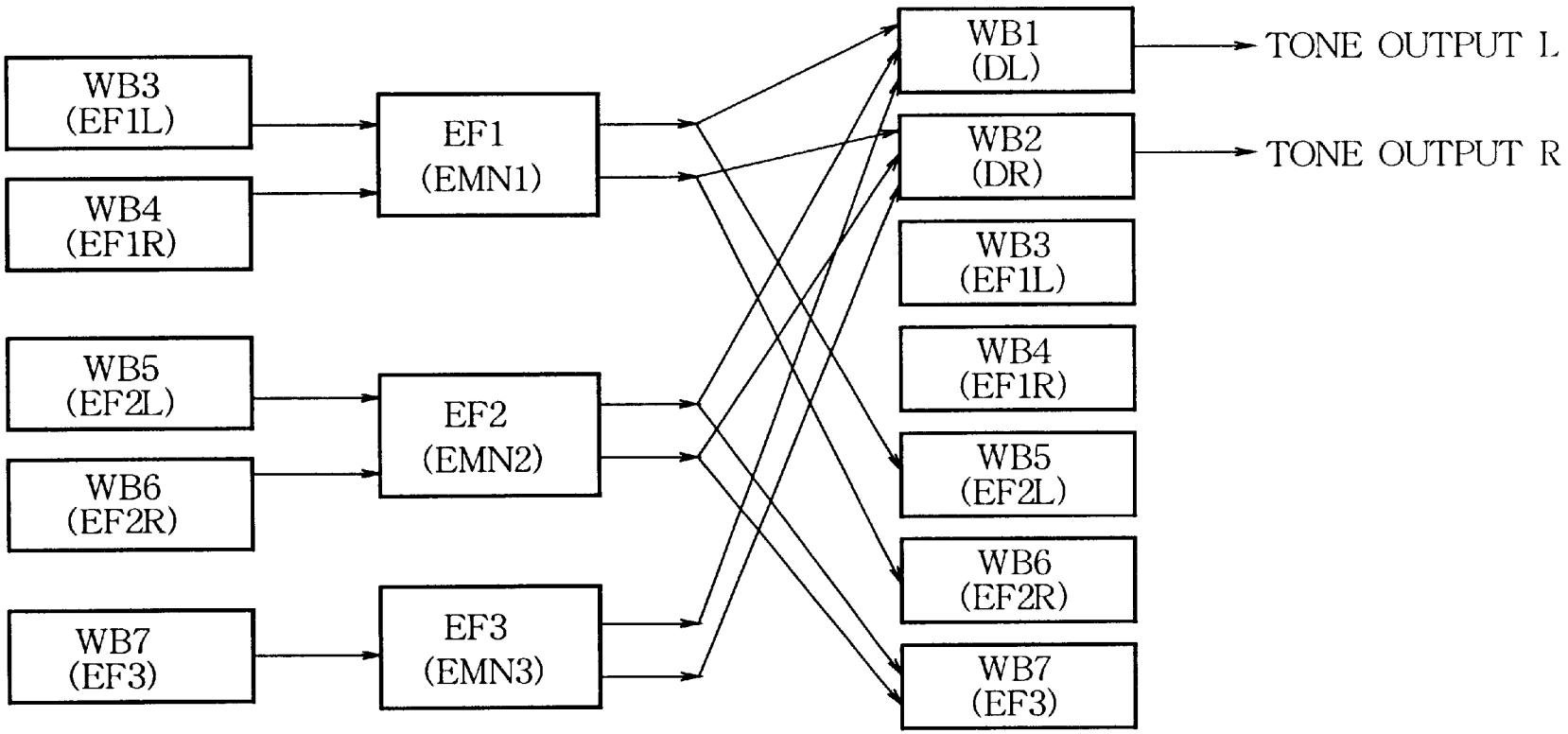
FIG. 7 is a diagram illustrating an operation of the preferred embodiment shown in FIG. 1.

For ease of understanding, an example of a tone synthesizing system configured in the part setting window 50 is shown with reference to FIGS. 6 and 7. In these figures, each solid-line arrow denotes that a send level other than 0 is set. In FIG. 6, for example, the solid-line arrows run from part 1 to buffers WB1, WB2, and WB5 through WB7. These arrows denote that the send levels DS1, 1S1, and 2S1 of the signals to these buffers take values other than 0, and the send level 1S1 to the buffers WB3 and WB4 are set to 0. TMN1 shown in parentheses under part 1 denotes the module number TMN1 (refer to FIG. 13(D)) of the tone generator module shown in part 1.

A solid-line arrow runs from part 2 to an insertion effect IEF1. This arrow denotes that "2" is set as the part number of a part to which the insertion effect IEF1 is to be imparted. Namely, a tone signal generated by the performing part 2 is supplied to the insertion effect IEF1 through the buffer WB8.

An insertion effect is level-controlled by the panning level and send level set to the part to which the insertion effect is to be imparted, and the resultant insertion effect is outputted to the associated buffer. In FIG. 6, solid-line arrows run from the insertion effect IEF1 to the buffers WB1 through WB4. This denotes that DS2 and 1S2 of the send levels set to the part 2 to which the insertion effect IEF1 is to be imparted are other than 0, and the send levels 2S2 and 3S2 are set to 0. It should be noted that the term "insertion effect" is generally used to mean "an effect to be inserted into a part." The label IEMN1 below the insertion effect IEF1 indicates module number IEMN1 (refer to FIG. 13(D)) of the effect module set to IEF1. The same holds true for parts 3 through 16, the connection having the send levels other than 0 are set being valid for each of these parts.

As described, WB1 and WB2 are buffers for stereo output, WB3 and WB4 are buffers for stereo input, WB5 and WB6 are buffers for stereo input of the second block EF2, and WB7 is a buffer for monaural input of the third block EF3. These are indicated by solid-line arrows running from the buffers WB3 and WB4 to the effect block EF1 for example in FIG. 7. The label EMN1 below the first block EF1 indicates the module number EMN1 (refer to FIG. 13(E)) of the effect module set to the first block EF1. Solid-line arrows run from the effect block EF1 to the buffers WB1, WB2, WB5, and WB6. This denotes that values other than 0 are set to the send levels EDS1 and E2S1 of the EF1, and 0 is set to the send level E3S1. The same holds true for the effect blocks EF2 and EF3, the connection corresponding to the send levels to which values other than 0 are set being valid for each of these blocks.

Thus, the desired system can be configured by appropriately setting the send levels from each part to the buffers WB1 through WB7, the part numbers of the parts to which insertion effects are imparted, and the send levels from each effect block to the buffers WB1 through WB7, as shown in FIGS. 6 and 7. Namely, in the seventh aspect of the invention, the inventive method is designed for synthesizing a musical tone signal by executing a control program and a plurality of music programs including tone generator programs and effect creation programs and by using a multiple of buffer memories. The control program is executed to perform the steps of commanding a sequential execution of the plurality of the music programs to sequentially process the musical tone signal according to the T-sequence data and E-sequence data, and passing the musical tone signal among the music programs by means of the buffer memories during the sequential execution of the music programs. The plurality of the music programs are executed to perform the steps of generating the musical tone signal and storing the musical tone signal in the buffer memories in response to the commanding step, processing the musical tone signal stored in the buffer memories in response to the commanding step, controlling a volume or send level of the musical tone signal which is outputted by either of the generating step and the processing step, and accumulating the musical tone signal having the controlled volume into at least one of the buffer memories for synthesis of the musical tone signal.

Meanwhile, the above-mentioned E-sequence data is automatically determined based on the tone synthesizing system of the effect blocks. In the example shown, the effect block EF1 has the send level E2S1 of a value other than 0 for the buffers WB5 and WB6. The output of this effect block is supplied to the effect block EF2 through the buffers WB5 and WB6.

If the processing of the effect block EF2 is executed before the effect block EF1, the result of the processing of the effect block EF1 is reflected on the processing result of the effect block EF2. Consequently, the processing of the effect block EF1 must always be executed before the effect block EF2. Likewise, the effect block EF2 has the end level E3S2 whose value is other than 0 to the buffer WB7 and the effect block EF3 selects the buffer WB7 as the input buffer. Consequently, the processing of the effect block EF2 must always be executed before the effect block EF3. Thus, in the example shown in FIG. 7, the E-sequence data is determined to specify the order of (1) EF1, (2) EF2, and (3) EF3. For other various connection examples, the above-mentioned analysis based on the send levels is also executed, thereby automatically determining the E-sequence data. The E-sequence data thus determined is stored in the E-sequence data storage area shown in FIG. 13(E). Namely, In the sixth aspect of the invention, the inventive method is designed for processing a musical tone signal by sequentially executing a plurality of signal processing modules to impart corresponding effects to the musical tone signal. The inventive method comprises the steps of designating connections among the plurality of the signal processing modules such as effect modules, determining the sequence in the executing of the plurality of the signal processing modules according to the designated connections, generating a fragment of the musical tone signal at a predetermined interval, executing the plurality of the signal processing modules in the determined sequence denoted by the E-sequence data at each predetermined interval to impart the corresponding effects to the fragment of the musical tone signal such that the fragment of the musical tone signal processed by a preceding signal processing module is passed to a succeeding signal processing module according to the designated connections, and mixing the fragments processed by the plurality of the signal processing modules to synthesize the musical tone signal.

4.3 Inputting a Trigger Message

As a general rule, a trigger message to be supplied from the operating system 2 occurs at a predetermined interval (for example, several milliseconds). As a general rule, the integrated driver 3, the tone generator modules 5, 6, and so on, and the effect modules 7, 8, and so on generate waveform data at each predetermined interval and output the generated waveform. This generates a sequence of waveform data along the time axis in each module. However, the intervals at which trigger messages are generated are not always accurate. They may be delayed or lost depending on the operating time of the operating system or other application program. If this happens, each module must generate waveform data that extends over the predetermined timing to compensate the delay or loss. The following describes this waveform data generating processing.

Figure 10:
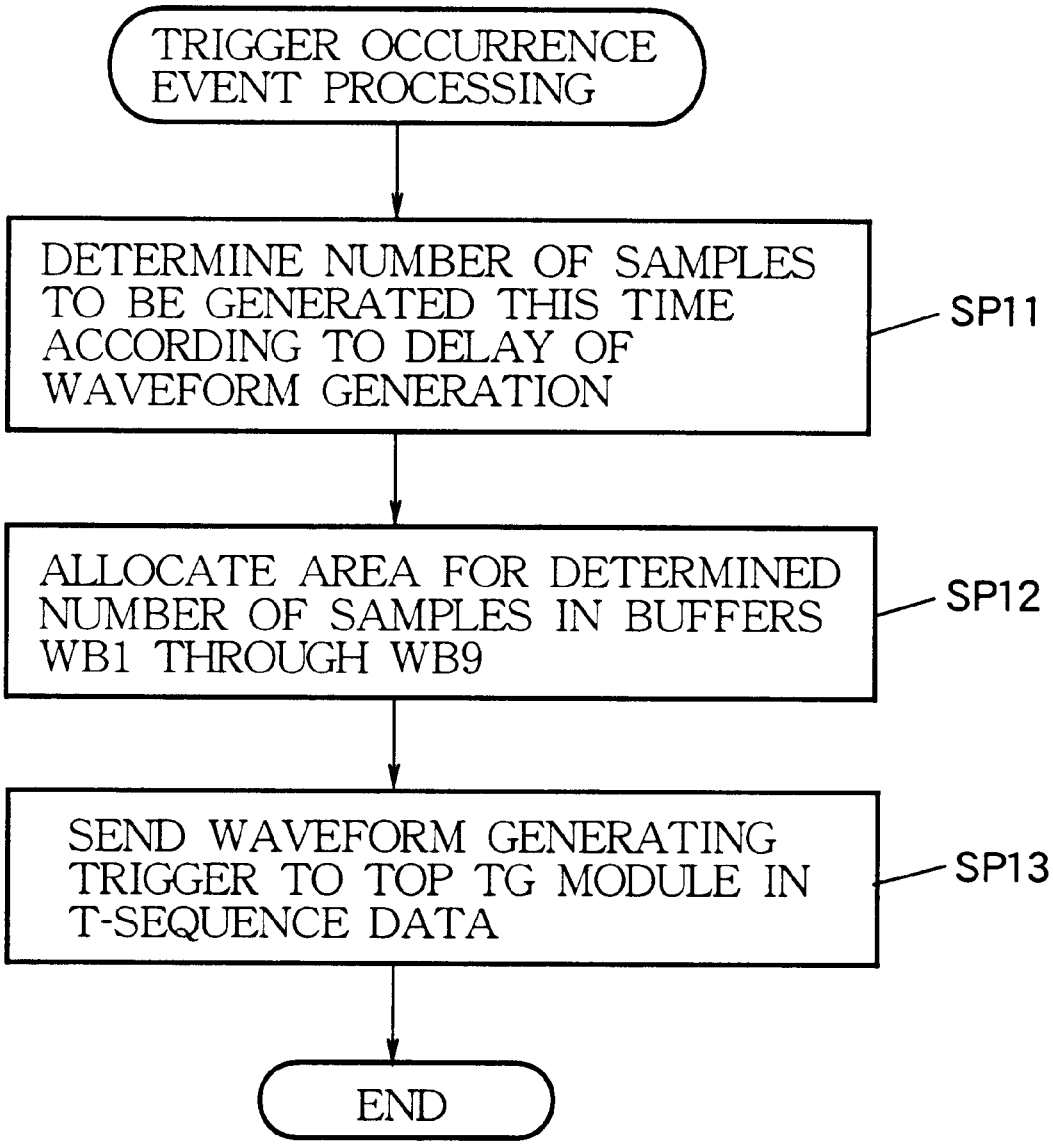
FIG. 10 is a flowchart showing a trigger occurrence event processing routine.

When a trigger message is supplied from the operating system 2, a trigger occurrence event processing routine shown in FIG. 10 starts in step SP107 shown in FIG. 5. Referring to FIG. 10, in step SP11, the current number of generated samples is determined according to the delay in the waveform generation.

Next, in step SP12, the storage areas for that number of samples are prepared in the buffers WB1 through WB9. The buffers WB1 through WB9 are buffer areas having a predetermined length (for example, 1024 words×9) allocated in the RAM 23 beforehand. If a trigger message generation timing is normal, the areas are allocated in fragments (for example, 128 words×9) in step SP12.

Obviously, if delay or loss of a trigger message occurs, the areas to be allocated are changed. In the above-mentioned preferred embodiment, the length of each of the buffers WB1 through WB9 is referred to as a frame. The frame is also a unit in which waveform data is outputted.

In step SP13, the waveform buffers WB1 through WB9 and the number of the samples are assigned to the top tone generator module specified in the T-sequence data and a waveform generating trigger is sent to that module. This waveform generating trigger is an instruction for starting the synthesizing of waveform data and includes the number of samples of waveform data to be generated in the buffers WB1 through WB9. When these processing operations have been completed, the processing returns to the integrated driver main routine (refer to FIG. 5). In the main routine, a waveform generating trigger event processing routine shown in FIG. 16 starts in the process of the top tone generator module based on the waveform generating trigger that was sent. The details of the processing routine will be described later.

4.4 Inputting a MIDI-Out Message

Figure 11:
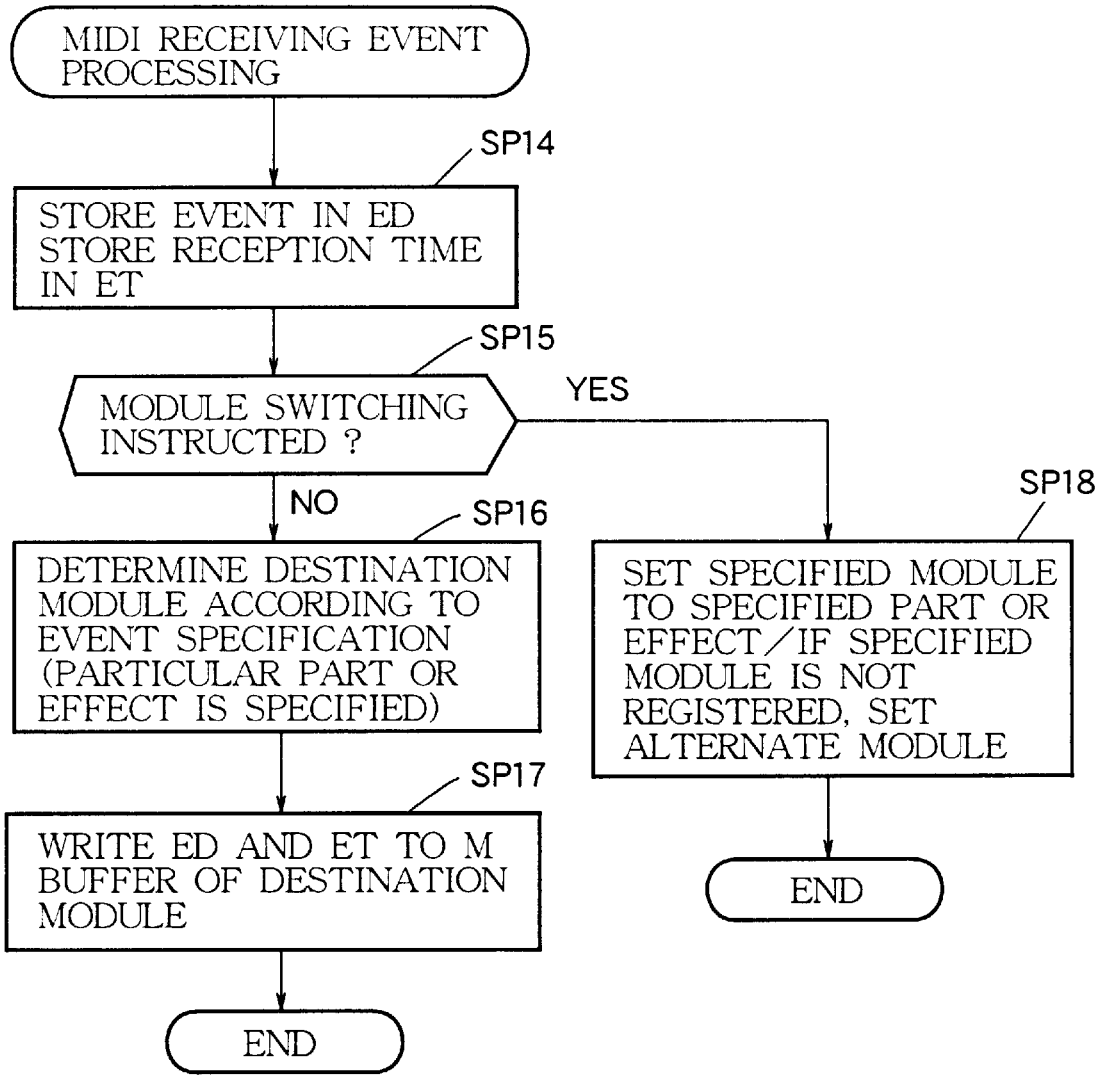
FIG. 11 is a flowchart for a MIDI reception event processing routine.

When a MIDI-Out message is inputted from the music application software 1, the processing goes to step SP106 in the integrated driver main routine (refer to FIG. 5), in which a MIDI reception event processing routine shown in FIG. 11 starts. In the figure, when the processing goes to step SP14, the contents of the event associated with the MIDI-Out message are stored in a variable ED. At the same time, the time at which the MIDI-Out message was received is stored in a variable ET.

In step SP15, it is determined whether module switching is requested in the MIDI-Out message. Generally, the tone generator module switching is instructed by a MIDI program change message and/or a control change message, and the effect module switching is instructed by a parameter change message. If one tone generator module or one effect module supports two or more timbres or effects and timbre switching or effect switching is executed in that range, no module switching occurs.

If the decision is YES in step SP15, then, in step SP18, the tone generator module of the specified part is changed to a new tone generator module or the specified effect is set. However, if the specified tone generator module or effect module is not included in the registered range, an alternate module is set.

On the other hand, if the decision is NO in step SP15, the processing goes to step SP16. In this step, a module to which the MIDI-Out message is to be sent is determined according to the contents of the message. For example, in the case of a note-on or note-off message, that message corresponds to particular one of the parts, so that the tone generator module for use in generating the particular part is selected as the destination module. For an event such as effect amount change, a corresponding effect module is selected as the destination.

In step SP17, the event contents ED and the reception time ET are written to the M buffer of the destination module. When the above-mentioned processing is completed, the processing flow returns to the integrated driver main routine (refer to FIG. 5). Based on the data written to the M buffer, a MIDI event processing routine shown in FIG. 15 starts as another process. This will be described later in detail.

4.5 Receiving Waveform Data

Figure 12:
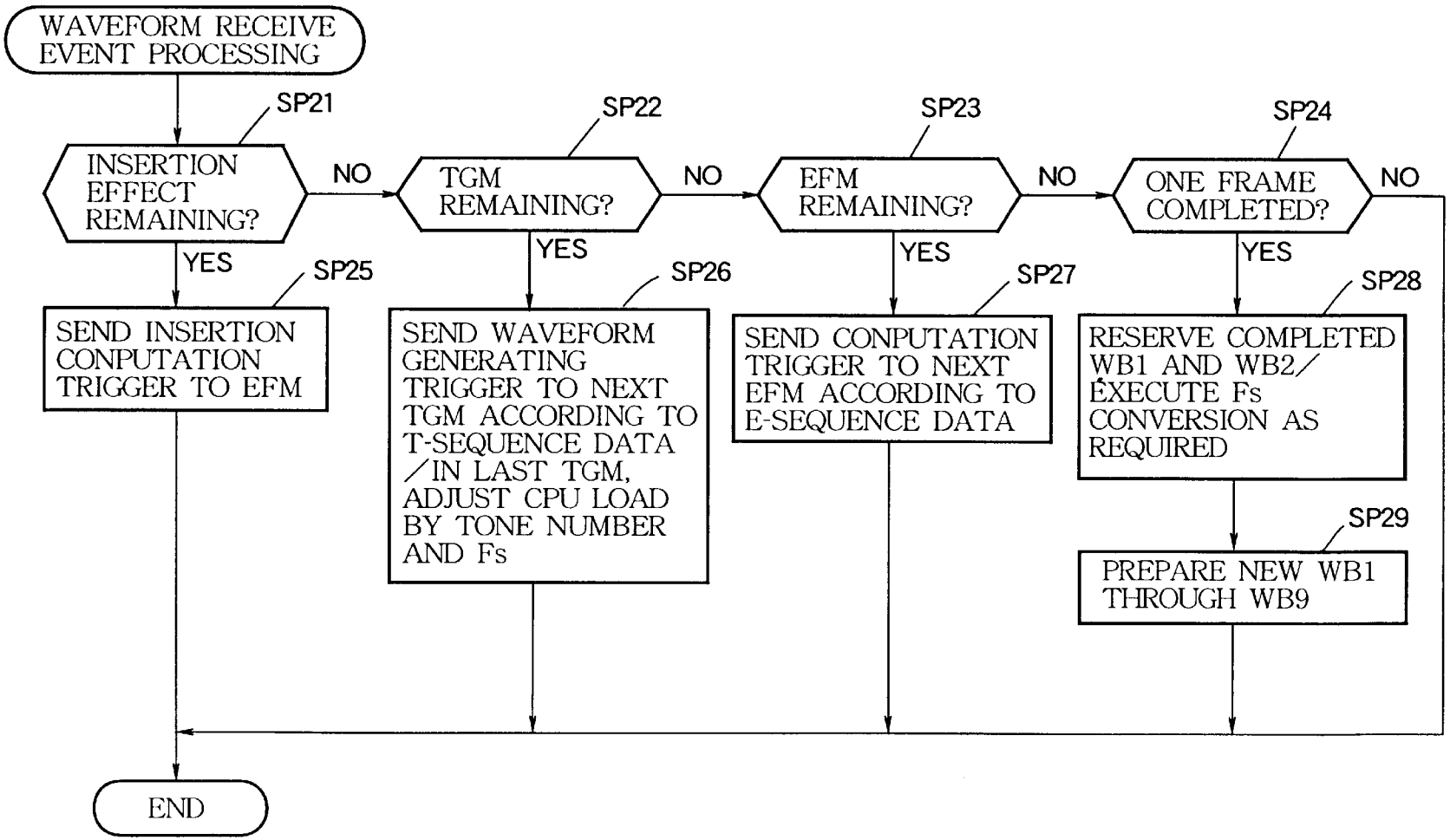
FIG. 12 is a flowchart for a waveform reception event processing routine.

Every time waveform data generation or effect processing is completed in any one of the tone generator modules 5, 6, and so on or the effect modules 7, 8, and so on, the completion is detected in step SP103 of the integrated driver main routine (refer to FIG. 5). In doing so, the waveform buffers WB1 through WB9 are returned from each module. The waveform data processed in the module in question is stored in these waveform buffers. Based on the stored waveform data, the processing goes to step SP108, in which a waveform receiving event processing routine shown in FIG. 12 starts. In step SP21 shown in FIG. 12, it is determined whether the processing of the insertion effect corresponding to the tone generator module executed last has been completed. This determination is made when there exists a relationship between the part 2 and the insertion effect IEF1 shown in FIG. 6, and immediately after completion of the generation of the waveform data in the tone generator module TMN2 set to the part 2. If the decision is YES, then the processing goes to step SP25. In this step, the waveform buffers WB1 through WB9, the number of generated samples, and an insertion computation trigger are sent to the effect module EFM specified by module number IEMN1, upon which a computation trigger event processing routine (refer to FIG. 17) starts in the process of the effect module EFM in question.

On the other hand, if the decision is NO in step SP21, then it is determined whether any of the tone generator modules is generating the waveform data corresponding to the current trigger message in step SP22. If the decision is YES, the processing goes to step SP26. In this step, the waveform buffers WB1 through WB9, the number of samples, and the waveform generating trigger are sent to a next tone generator module according to the T-sequence data, upon which a waveform generating trigger event processing routine (refer to FIG. 16) starts in the process of the tone generator module TGM in question. When the processing of step SP25 or SP26 has been executed, the processing returns to the integrated driver main routine (refer to FIG. 5).

In view of the above-mentioned processing, the waveform computation of the portion associated with tone generator modules and insertion effect modules is executed on the tone synthesizing systems as shown in FIGS. 6 and 7 before the system effect module processing. This is because no system effect can be impart unless the waveform data generated by tone generator modules and insertion effects is identified. However, execution of the tone synthesizing system by the CPU 21 may cause a problem. To be more specific, if there is no processing power enough for operating the system effects after operating a tone generator module by the CPU 21, the processing of some of the system effects must be omitted. This presents a significant auditory problem.

To circumvent this problem, if the CPU 21 processing power is insufficient, the above-mentioned preferred embodiment sacrifices some of the tone generator modules, preventing the problem from affecting the system effects. To be more specific, when sending the waveform generating trigger to the last tone generator module in the T-sequence in step SP26, the remaining amount of the CPU load is computed in advance.

If the CPU power is found short, one of the following measures is taken to mitigate the CPU load associated with the tone generator module in question:

(1) the number of tones of the last tone generator module is reduced;

(2) if the local sampling frequency TFs of the last tone generator module is variable, the TFs is lowered; and (3) the processing contents (namely, music generating algorithm) of the last tone generator module are changed to simpler one.

Obviously, the above-mentioned measures cannot completely avoid the adverse effect on generated tones. However, taking these measures is often better than encountering a trouble in which a system effect is abruptly discontinued. In determining the T-sequence data described before, control is executed so that tone generator modules which are modifiable or alterable in computation contents and have more tone generating channels are placed backward in the sequence. This is because these flexible tone generator modules are suitable for CPU load adjustment. Namely, In the fifth aspect of the invention, the inventive method is designed for synthesizing a musical tone signal by using a processor to sequentially execute a plurality of tone generator modules including a flexible one capable of altering a mode of generating a musical tone, and an inflexible one not capable of altering a mode of generating a musical tone. The inventive method comprises the steps of determining a sequence in the executing of the plurality of the tone generator modules such that the inflexible one precedes to the flexible one, executing the plurality of the tone generator modules in the determined sequence by the processor having a variable working load to generate the musical tones, controlling the flexible one to alter the mode of generating the musical tone dependently on the working load of the processor after the inflexible one has been executed in precedence to the flexible one, and mixing the musical tones generated from the plurality of the tone generator modules to synthesize the musical tone signal. Preferably, the inflexible one is capable of generating a fixed number of musical tones at once, and the flexible one is capable of generating a variable number of the musical tones at once such that the flexible one is controlled to alter the variable number of the musical tones dependently on the working load of the processor. Preferably, the flexible one is capable of altering a computation amount consumed to generate a musical tone, and inflexible one is not capable of altering the computation amount such that the flexible one is controlled to alter the computation amount dependently on the working load of the processor.

Thus, when a final waveform generating trigger has been sent to the last tone generator module, all of the waveform data are generated, thereby generating a waveform data receiving event. If this happens, the processing goes to step SP23 through the steps SP21 and SP22. In step SP23, it is determined whether there is any effect module not yet processed. It should be noted that, of the effect processing operations to be executed by an effect module, the insertion effect processing has all been completed before the execution of step SP23 (refer to steps SP21 and SP25).

If the decision is YES in step SP23, the processing goes to step SP27. In step SP27, the waveform buffers WB1 through WB9, the number of generated samples, and a computation trigger are sent to the effect module set to a next effect block EFn according to the E-sequence data, upon which a computation trigger event processing routine (refer to FIG. 18) starts in the process of that effect module. When the effect processing of the waveform data in that effect module has been completed, the waveform receiving event processing routine (refer to FIG. 12) is called again. The processing of step SP27 is repeated until the processing of all effect modules is completed.

When this routine is called again after completion of the effect processing of the waveform data in the last effect module, the decision is NO in step SP23, upon which the processing goes to step SP24. It should be noted that, when the processing goes to SP24, the generation of the waveform data responsive to the trigger messages has been all completed. In step SP24, it is determined whether one frame of waveform data has been generated. If the decision is YES, the processing goes to step SP28, in which reservation is made for reproduction by the CODEC driver of one frame of the waveform data stored in the buffers WB1 and WB2. It should be noted that, if the system sampling frequency SFs is different from the output sampling frequency OFs (which is equal to the sampling frequency of the CODEC), sampling frequency conversion processing by the Fs converting block 3*e* is also executed in step SP28.

In step SP29, new buffers WB1 through WB9 are allocated in the RAM 23, clearing the contents thereof. The new buffers are allocated because the contents of the used buffers WB1 and Wb2 have been not yet outputted and therefore the RAM 23 is left uncleared.

4.6 Main Routine of Each Module

Figure 14:
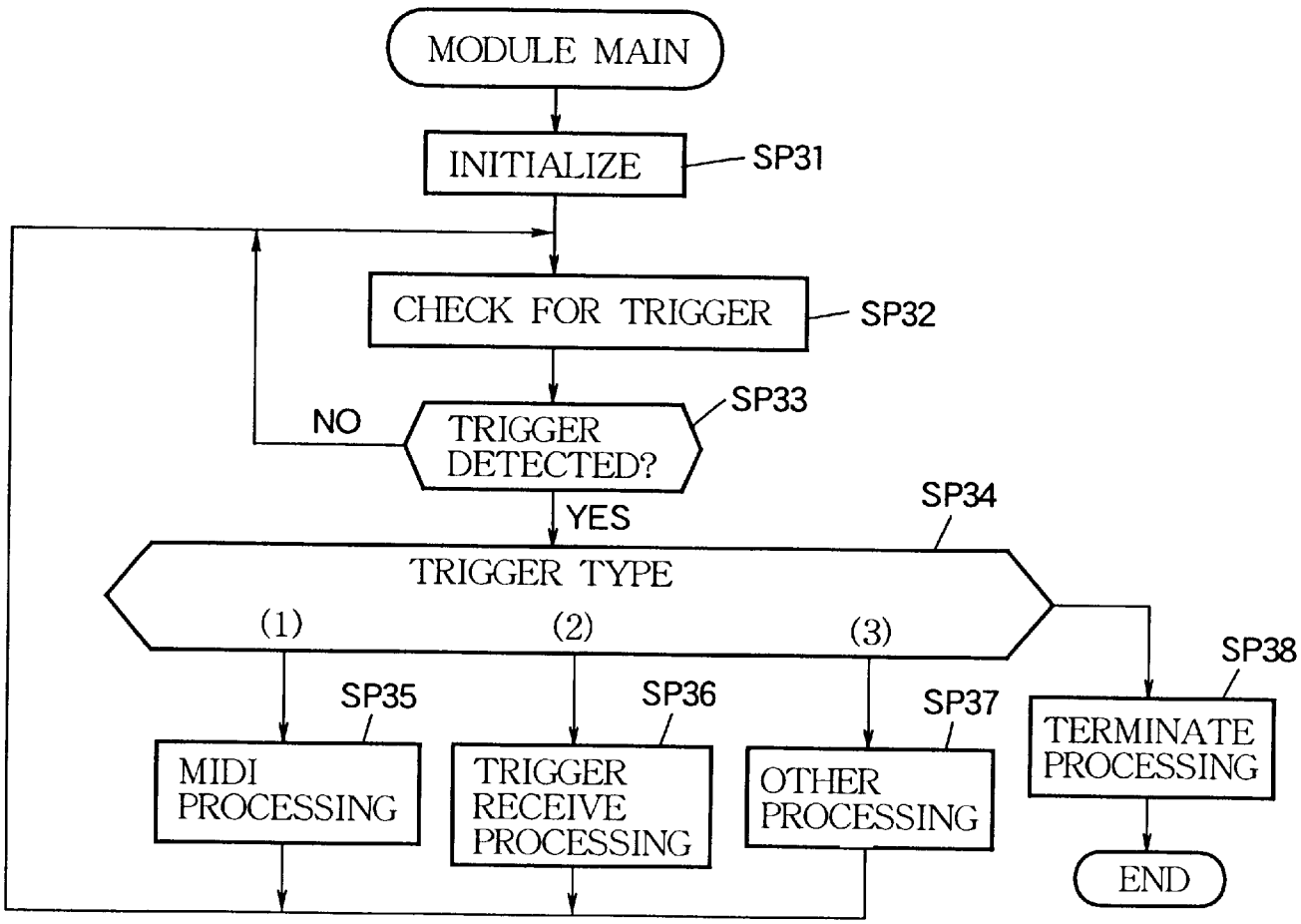
FIG. 14 is a flowchart for a module main routine.

The following describes detail operations of the tone generator modules 5, 6, and so on and the effect modules 7, 8, and so on. First, for the registered modules, the module main routine shown in FIG. 14 is executed at the start of the integrated driver 3. For the modules newly registered through the registration window as shown in FIG. 8, the module main routine starts at the registration. In either case, the module main routine starts in separate processes.

In step SP31, a predetermined initializing operation is executed. For the modules capable of selecting local sampling frequency TFs, an optimum local sampling frequency TFs is selected according to the system sampling frequency SFs. To be more specific, if the system sampling frequency SFs can be matched with the local sampling frequency TFs, the sampling frequency conversion processing is unnecessary. Therefore, the matching frequency is selected with top priority. For example, if one of 44 KHz and 22 KHz is selectable as local sampling frequency TFs and the system sampling frequency SFs is 22 KHz, no advantage is gained in generating waveform data at 44 KHz, so that the local sampling frequency TFs is set to 22 KHz. It should be noted that if a local sampling frequency TFs that matches the system sampling frequency SFs does not exist, a frequency nearest to the system sampling frequency SFs is selected. If there exist two nearest frequencies, the lower one is selected.

In step SP32, it is determined whether a trigger has occurred. The trigger is one of the following:

(1) occurrence of a MIDI event (writing of event contents ED and reception time ET to the M buffer in step SP17);

(2) reception of various triggers (in steps SP17, SP25, and so on);

(3) inputting of an end message by the operating system, or module registration or deletion through the registration window as shown in FIG. 8; and (4) inputting of other messages.

In steps SP32 and SP33, the processing waits until some trigger occurs. When a trigger has occurred, the processing goes to step SP34, in which the processing responsive to the detected trigger is executed. If inputting of an end message is detected, the processing goes to step SP38, in which the terminate processing of the module main routine is executed. In other cases, the processing responsive to a detected trigger is executed and then the processing routine returns to step SP32. The following describes the processing operations responsive to various triggers in various cases.

4.7 MIDI Event Processing Routine

Figure 15:
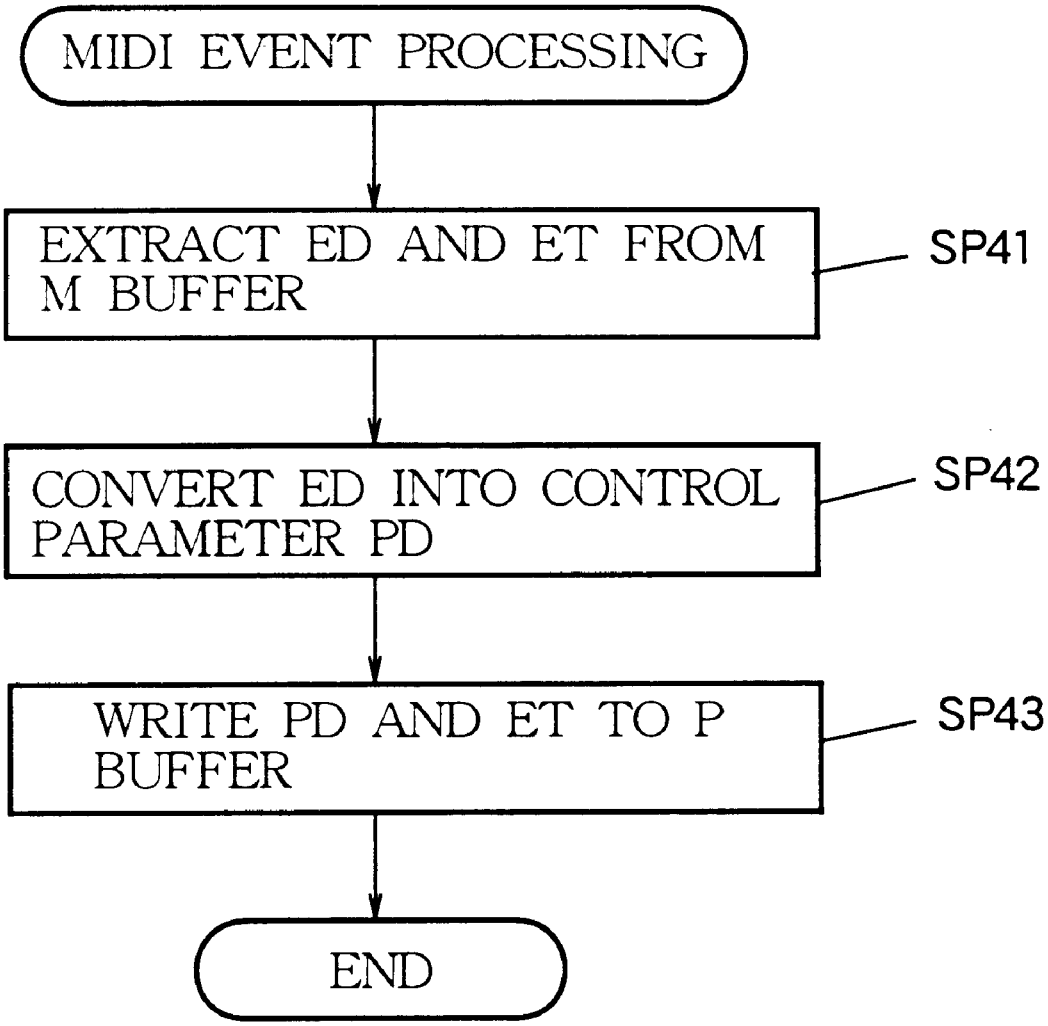
FIG. 15 is a flowchart for a MIDI event processing routine.

When writing of a MIDI event to the M buffer is detected in step SP32, the processing goes to step SP35 in the module main routine, thereby calling the tone generator module MIDI event processing routine as shown in FIG. 15. In step SP41, event contents ED and the reception time ET are read from the M buffer. It should be noted that these items of data were written to the M buffer in step SP17 of the MIDI receiving event processing routine (refer to FIG. 11). Next, in step SP42, the event contents ED are converted into parameter data PD. For example, if the event contents ED are a note-on, a part, a pitch, and a velocity of the note are specified. If the tone generator module is an FM tone generator, the pitch and the velocity are converted based on a timbre of the selected part into parameter data PD including such parameters unique to the FM tone generator as individual operator's frequency, phase, and level. At the same time, a sounding channel for sounding a resultant tone is determined.

In step SP43, the parameter data PD, the sounding channel, and the reception time ET are written to a storage area for the part in question in the P buffer (parameter buffer) allocated to that module. Then, the processing flow returns to the module main routine (refer to FIG. 14).

Figure 16:
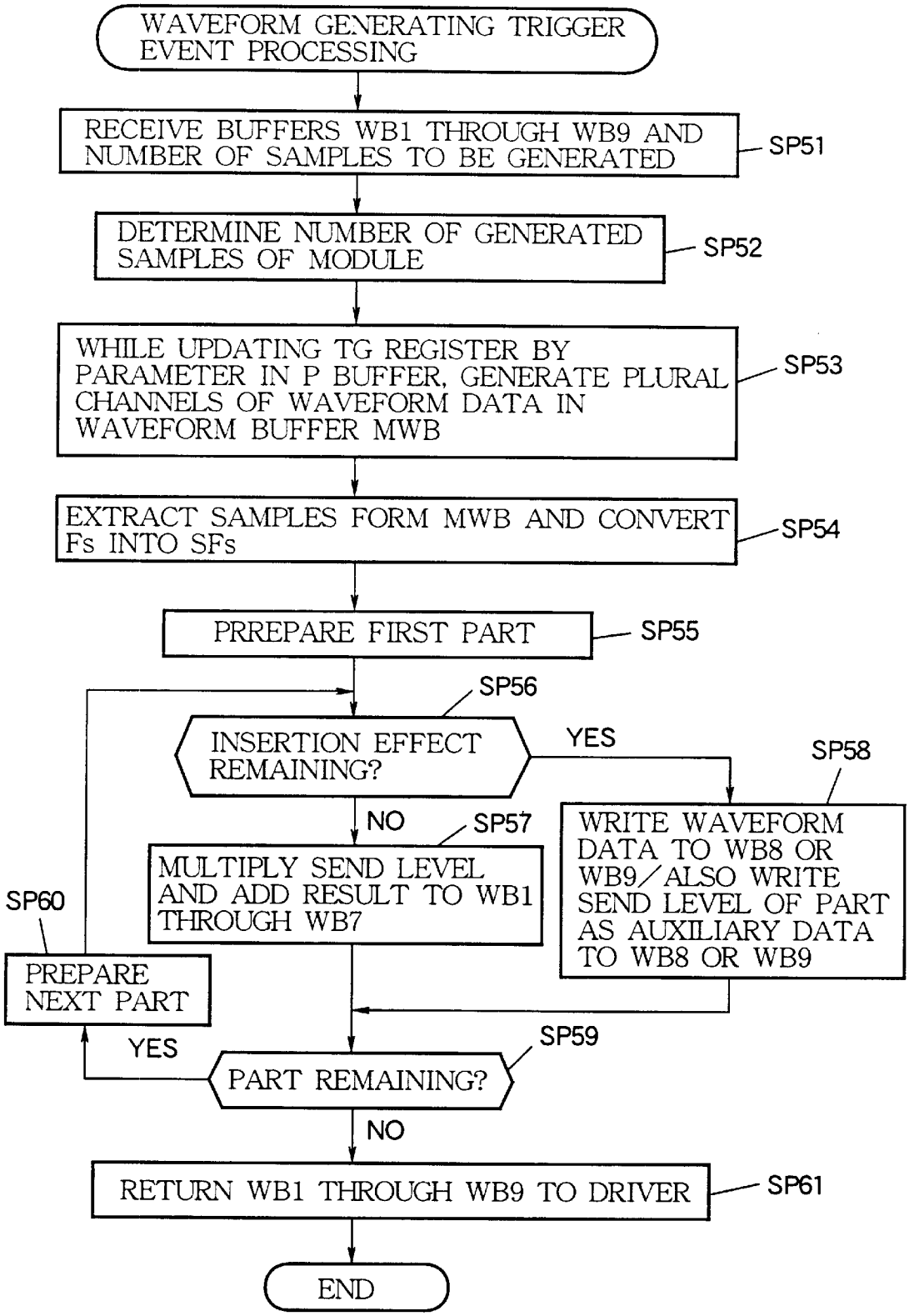
FIG. 16 is a flowchart for a waveform generation trigger event processing routine.

4.8 Waveform Generating Trigger Event Processing Routine (FIG. 16)

When reception of a waveform generating trigger is detected in step SP32 of the module main routine, then a waveform generating trigger event processing routine shown in FIG. 16 of the tone generator module is called in step SP36. It should be noted that this waveform generating trigger has occurred in step SP13 of the trigger generating event processing routine (refer to FIG. 10) and step SP26 of the waveform receiving event processing routine (refer to FIG. 12).

In step SP51 in FIG. 16, pointers of the write addresses of the buffers WB1 through WB9 and the number of generated samples to be generated are received. Because the number of the samples is a value counted in terms of system sampling frequency SFs, it does not always match the number of actually generated samples in the tone generator module in question. Therefore, in step SP52, the number of the samples in terms of the system sampling frequency SFs is converted into the number of the samples in terms of the local sampling frequency TFs based on the ratio of system sampling frequency SFs to local sampling frequency TFs.

If the waveform generating trigger event processing routine was executed before, some samples may have been generated. Details of this point will be described later. Briefly, in this case, the already generated samples are carried over to the waveform data to be outputted this time. Therefore, the required number of samples is obtained by subtracting the number of already generated samples from the number of the samples measured in local sampling frequency TFs.

In step SP53, multiple channels of waveform data is generated while updating the contents of the registers in the tone generator module based on the parameter data PD in the P buffer, the generated waveform data being accumulated in a module waveform buffer MWB. The module waveform buffer MWB is allocated for each module in addition to the buffers WB1 through WB9. The module waveform buffer MWB is also allocated for each part if the tone generator module in question generates waveform data for multiple parts. In step SP53, the waveform data is generated in a practical number of samples suitable for the processing of the module, this practical number of samples being greater than the required number of samples.

For example, if the CPU 21 has a cache capability or a parallel processing capability and is capable of efficiently generating 16 samples of waveform data for example, setting the number of samples to be generated to a multiple of 16 leads to the most efficient use of the processing capacity of the CPU 21. For example, if the required number of samples obtained in step SP52 is 130, 144 samples which are the lowest of the multiples of 16 and higher than 130 are generated.

Besides, the number of samples to be generated depends on not only hardware but also software requirements. For example, a technique is known in which the envelop waveform of a tone signal is updated not for every sample but every 16 samples for example to mitigate the processing load. In this case also, the number of samples to be generated is preferably set to a multiple of 16.

In step SP54, the required number of samples ( 130 in the above-mentioned example) of waveform data are taken from the module waveform buffer MWB, and the sampling frequency TFs of this waveform data is converted into the system sampling frequency SFs. If the sampling frequency TFs is equal to the system sampling frequency SFs, the sampling frequency TFs need not be converted, so that step SP54 is skipped. In step SP55, outputting of the waveform of the first part stored in the module waveform buffer MWB is prepared. The first part denotes the first one of multiple parts to be generated in the tone generator module in question. Therefore, this first part does not always match the part 1 of MIDI.

As described above, the inventive method is designed according to the first aspect of the invention for synthesizing a musical tone signal by executing a control program and a plurality of generator programs or the tone generator modules with a processor. The control program is executed to perform the steps of commanding each of the generator programs to generate a predetermined number of samples of the musical tone signal at a first sampling period(system sampling period), and collecting the samples from each of the generator programs and processing the collected samples at the first sampling period to thereby synthesize the musical tone signal. The generator programs include a synchronous generator program that does generate the predetermined number of the samples at the first sampling period, and an asynchronous generator program that does not generate the predetermined number of the samples at the first sampling period. The asynchronous generator program is executed to perform the steps of generating an equivalent number of samples at a second sampling period (local sampling period) in response to the commanding from the control program, the equivalent number of the samples arranged at the second period being determined to correspond to the predetermined number of the samples arranged at the first sampling period, and converting the equivalent number of the samples arranged at the second sampling period into the predetermined number of the samples arranged at the first sampling period to thereby pass the predetermined number of the samples to the control program at the first sampling period.

As described above, according to the second aspect of the invention, the inventive method of synthesizing a musical tone signal comprises the steps of designating a first sampling period to determine a rate of synthesis of the musical tone signal, adopting a second sampling period from among a plurality of available sampling periods according to the designated first sampling period, generating the musical tone signal at the adopted second sampling period, converting the generated musical tone signal from the adopted second sampling period into the designated first sampling period when the second sampling period is different from the first sampling period to output the converted musical tone signal at the designated first sampling period, otherwise outputting the generated musical tone signal as it is when the adopted second sampling period is identical to the designated first sampling period, and processing the outputted musical tone signal at the designated first sampling period for the synthesis of the musical tone signal.

As described above, According to the third aspect of the invention, the inventive method of synthesizing a musical tone signal comprises the steps of commanding a generation of a predetermined number of samples of the musical tone signal at a first sampling period such that the predetermined number of the samples are sequentially arranged at the first sampling period, the generation being commanded recurrently to continue the musical tone signal, generating a practical number of samples of the musical tone signal in response to the commanding at a second sampling period which is different from the first sampling period, the practical number being determined to make efficient the generation of the musical tone signal and to cover the predetermined number of the samples, collecting a number of samples generated but unprocessed in a previous generating step and reserved in a memory, and a part of the practical number of the samples generated in the current generating step such that a total number of the collected samples is equivalent to the predetermined number of the samples, converting the collected number of the samples arranged at the second sampling period into the predetermined number of the samples arranged at the first sampling period to output the musical tone signal, and reserving the remaining part of the practical number of the samples generated but left in the current generating step into the memory for use in a next generating step.

As described above, according to the fourth aspect of the invention, the inventive method of synthesizing a musical tone signal comprises the steps of commanding a generation of a predetermined number of samples of the musical tone signal, the generation being commanded recurrently to continue the musical tone signal, generating a practical number of samples of the musical tone signal in response to the commanding, the practical number being determined to make efficient the generation of the musical tone signal and to cover the predetermined number of the samples, collecting a number of samples generated but unprocessed in a previous generating step and reserved in a memory, and a part of the practical number of the samples generated in the current generating step such that a total number of the collected samples is equivalent to the predetermined number of the samples, processing the collected number of the samples to synthesize the musical tone signal, and reserving the remaining part of the practical number of the samples generated but unprocessed in the current generating step into the memory for use in a next generating step.

In step SP56, it is determined whether an insertion effect is set to the part in question. If the decision is YES, then, in step SP58, the waveform data of the part in question in the module waveform buffer MWB is written to the buffer WB8 or WB9. At the same time, the send level and panning level of the part in question are also written.

In step SP59, it is determined whether there remain any parts for which the waveform data is to be generated in the tone generator module in question. If the decision is YES, then, in step SP60, the waveform data of the next part stored in the module waveform buffer MWB is prepared, upon which the processing goes back to step SP56. If no insertion effect is set in this new part, the processing goes to step SP57. In step SP57, the send level corresponding to the send level and the panning level set to that part is multiplied by the waveform data in the buffers WB1 through WB7, each multiplication result being added to the original values of the buffers WB1 through WB7.

The processing of step SP57 or SP58 is likewise executed on all parts for which waveform data is generated by the tone generator module in question. In step SP61, the integrated main driver routine (refer to FIG. 5) is notified of the completion of the update operations for the buffers WB1 through WB9. This starts the waveform receiving processing (step SP108) as described above, calling the waveform receiving event processing routine (refer to FIG. 12).

Figure 17:
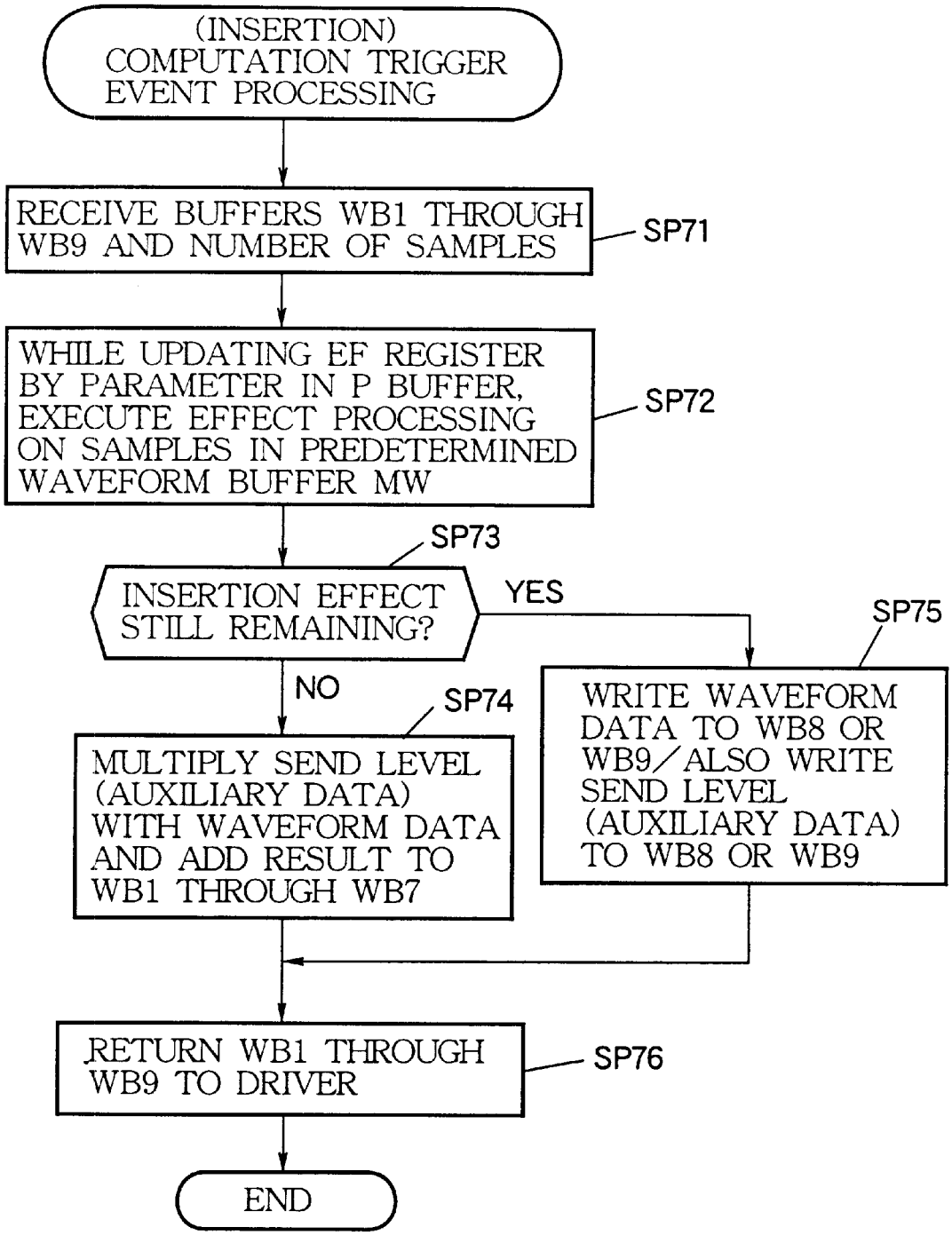
FIG. 17 is a flowchart for an insertion effect computation trigger event processing routine.

4.9 Computation Trigger Event Processing Routine (FIG. 17)

If the reception of a computation trigger for the insertion effect is detected in step SP32 of the module main routine, an effect module waveform generating trigger event processing routine shown in FIG. 17 is called in step SP36. This computation trigger has occurred for the insertion effect in step SP25 of the waveform receiving event processing routine (refer to FIG. 12). It should be noted that, if a system effect trigger has occurred in step SP27, another routine shown in FIG. 18 to be described later is called.

Now, in step SP71 in FIG. 17, the pointers of the write addresses of the buffers WB1 through WB9 and the number of generated samples are received. In step SP72, while updating the contents of registers in the effect module based on the value of the parameter register in the P buffer, insertion effect processing such as chorus or reverberation is executed on the waveform data in the input buffer (WB8 in the case of insertion effect IEF1, WB9 in the case of insertion effect IEF2). The effect-imparted waveform data is then stored in the module waveform buffer MWB in question.

In step SP73, it is determined whether the part to which an insertion effect is to be imparted remains. This is because two or more insertion effects may be imparted to one part. If the decision is YES, then, in step SP75, the effect-imparted waveform data is written to a next insertion effect input buffer. It should be noted that the send level and panning level set to a part to which an insertion effect is imparted in the processing of a tone generator module that generated the original waveform data are also set to the buffers WB8 and WB9, which are input buffers (refer to step SP58 of FIG. 16). These send level and panning level are written to the buffers WB8 or WB9 again along with the effect-imparted waveform data.

In step SP76, the integrated driver main routine (refer to FIG. 5) is notified of the completion of input buffer updating. This commences the waveform receiving processing (step SP108) as described above in the integrated driver main routine, calling the waveform receiving event processing routine (refer to FIG. 12).

In the above-mentioned example, an insertion effect remains for the part for which waveform generation was executed last, so that the decision is YES in step SP21, sending a computation trigger associated with the insertion effect again. Consequently, the computation trigger event processing routine (refer to FIG. 17) associated with the insertion effect is again called, thereby generating waveform data imparted with the effect through steps SP71 and SP72 as described above. If there remains ro insertion effect, the decision is NO in step SP73.

In step SP74, the send levels according to the send levels and panning levels (values attached to the input buffers) for the buffers WB1 through WB7 are multiplied by the waveform data in the buffer MWB, each multiplication result being added to the original values of the buffers WB1 through WB7. Then, in step SP76, the integrated driver main routine (refer to FIG. 5) is notified of the completion of the updating of the buffers WB1 through WB9, upon which this routine comes to an end.

Figure 18:
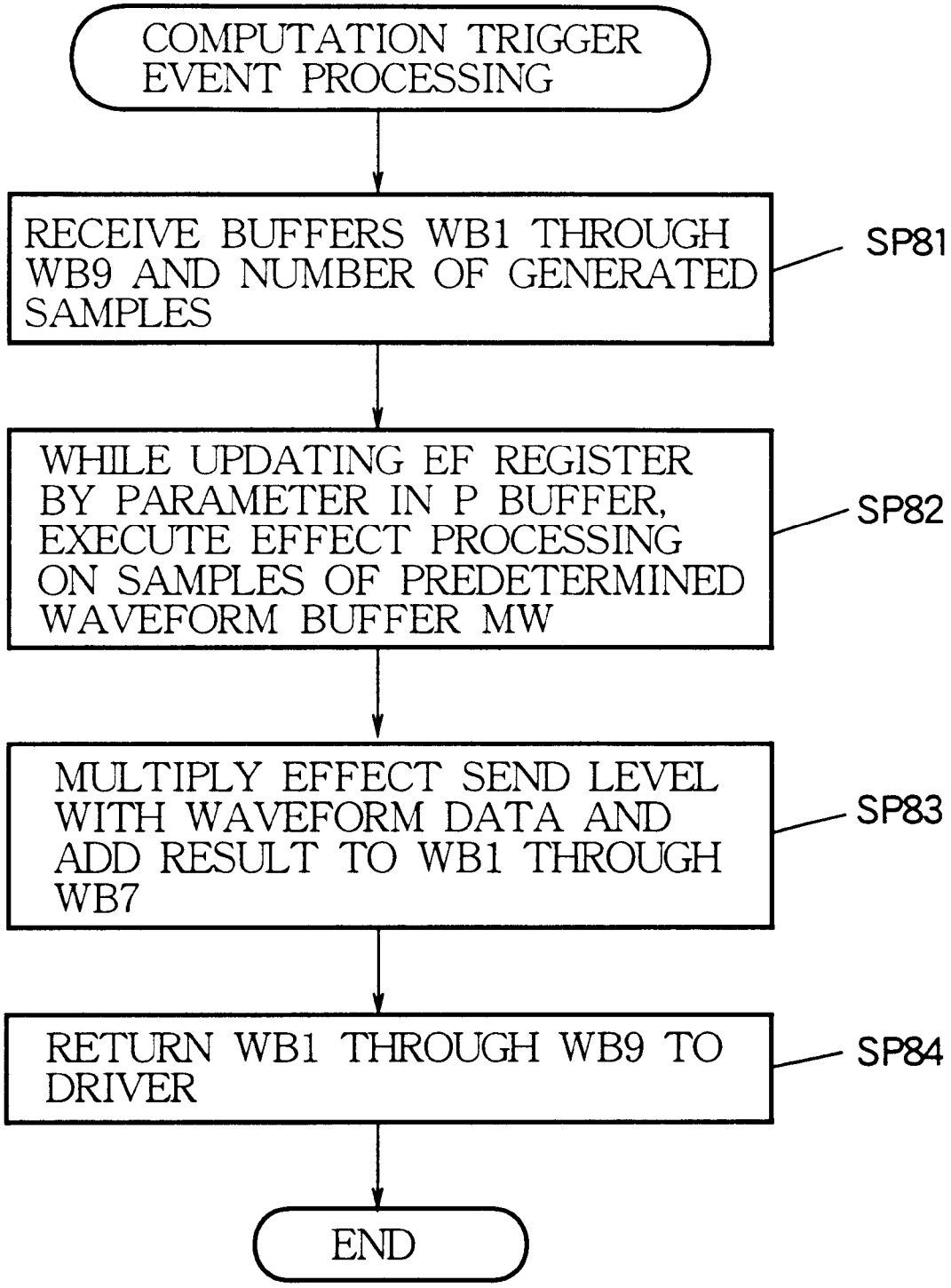
FIG. 18 is a flowchart for a system effect computation trigger event processing routine.

4.10 Computation Trigger Even Processing Routine (FIG. 18)

When reception of a computation trigger (refer to step SP26) for the system effect in step SP32 of the module main routine is detected, the effect module computation trigger event processing routine shown in FIG. 18 is called in step SP36. The processing of this routine is generally the same as that of the computation trigger event processing routine shown in FIG. 17. A difference is that the routine shown in FIG. 18 does not execute the processing corresponding to steps SP73 and SP75. This is because, with system effects, waveform data is always transferred by means of the buffers WB1 through WB7. The input buffer in step SP82 is any of the buffers WB1 through WB7. To be more specific, if the effect module in question is set to the first block EF1, the buffers WB3 and WB4 provide the input buffers. If the effect module in question is set to the second block EF2, the buffers WB5 and WB6 provide the input buffers. If the effect module in question is set to the third block EF3, the buffer WB7 provides the input buffer. The effect processing based on the parameter value specified by EPNn and updated according to the content of the P buffer of the effect module to be specified by EMNn is executed on the waveform data of each input buffer. The effect-imparted waveform data is stored in the module waveform buffer MWB. In step SP83, the send level corresponding to the send level set by the effect block EFn is multiplied with the waveform data in the module waveform buffer MWB. The multiplication result is then added to the original values of the buffers WB1 through WB7. In step SP84, the integrated driver main routine (refer to FIG. 5) is notified of the completion of the update operations on the buffers WB1 through WB9, upon which this routine comes to an end.

5. Effects of the Embodiment (1) As described, the preferred embodiment of the invention uses a concept of system sampling frequency SFs. Based on the system sampling frequency SFs, waveform data can be transferred between two or more tone generator modules, thereby simplifying the processing all over the system. Especially, the number of samples to be generated in each tone generator module may be specified by the system sampling frequency SFs, thereby significantly simplifying the control mechanism.

(2) In the preferred embodiment of the invention, if the selection of a local sampling frequency TFs is permitted, an optimum local sampling frequency TFs is selected according to the system sampling frequency SFs. This permits the effective use of CPU processing power, thereby preventing wasteful computations not contributing to the tone quality of final output.

(3) In the preferred embodiment of the invention, each tone generator module and each effect module can read the waveform data from the buffers WB1 through WB9, and add newly generated waveform data to the waveform data read from the buffers, thereby implementing multi-stage tone synthesis. Consequently, if the number of parts is increased, the area for the buffers WB1 through WB9 need not be increased, thereby significantly enhancing expandability. In addition, simple transferring of addresses between the modules can reduce the overhead of transferring the waveform data itself.

(4) In the preferred embodiment of the invention, provision of the T-sequence data can give lower priority to the computation of load-adjustable tone generator modules, thereby adjusting the load of the CPU according to its processing power.

6. Variations

The present invention is not limited to the above-mentioned preferred embodiment. The following variations may be made for example.

(1) The above-mentioned preferred embodiment is an example in which the present invention is executed on a personal computer. The present invention may also be applied to various musical apparatuses that have a tone parameter editing capability or a tone generating capability, such as general electronic musical instruments, game machines, and karaoke machines controlled by a processor and software. Further, the present invention may be implemented in the form of a recording medium of machine readable medium such as the removable disk 27 storing control programs that are installed on these musical apparatuses.

(2) In the above-mentioned preferred embodiment, a trigger message is generated from the operating system 2 at a predetermined time interval. It is also practicable to generate a trigger message from the hardware timer 24 or the waveform interface 30 for example. Generally, the temporal accuracy of a hardware trigger is higher than that obtained by having the operating system handle the trigger message processing. The trigger message generating interval may be set to a value equivalent to one frame for example.

(3) In the above-mentioned preferred embodiment, the size of each of the waveform buffers WB1 through WB9 is set to 1024 words. It will be apparent to those skilled in the art that the buffer size may be smaller or greater than 1024 words. In addition, the buffer size may be changed as required.

(4) In the above-mentioned preferred embodiment, the CPU load is adjusted in the tone generator module located last in the T-sequence. The CPU load adjustment may also be made in any tone generator module located before the last.

(5) In the above-mentioned preferred embodiment, when a tone generator module or an effect module is registered or deleted from the registration, its module main routine is started or ended. The module main routine may also be started when the module in question is selected by a MIDI part and ended when the module is deselected.

As described and according to the first aspect of the invention, a tone signal that, in response to an instruction to generate a tone signal having a length in unit of a first sampling frequency, generates a tone signal having a second sampling frequency. Then, the sampling frequency of the generated tone signal is converted into the first sampling frequency. According to this novel constitution, the number of generated samples can be specified by a common sampling frequency for all tone generating programs or modules even if these programs have different sampling frequencies. In addition, tone signals having the common sampling frequency can be received from all generating programs. Further, regardless of the first sampling frequency, each generating program can generate a tone signal indicated by a sampling frequency convenient to each generating program.

According to the second aspect of the invention, in response to a specified first sampling frequency, a second sampling frequency is selected from among a plurality of candidates. A tone signal having the selected second sampling frequency is generated. Then, the sampling frequency of that tone signal is converted into the first sampling frequency. According to this novel constitution, a tone signal can be generated with an optimum second sampling frequency in matching with the first sampling frequency, thereby efficiently synthesizing tones without involving wasted computation.

According to the third and fourth aspects of the invention, a tone signal is generated in unit of the number of computation samples suitable for the waveform generation, and a tone signal necessary for next conversion is written to a memory as an unprocessed tone signal. According to this novel constitution, even if the required number of samples is not suitable for the generation of a tone signal, it can be generated with the suitable number of samples, thereby efficiently operating a musical apparatus.

According to the fifth aspect of the invention, in execution a plurality of synthesizing processes, the number of tones or computation contents can be changed for the synthesizing process to be executed last or else, thereby efficiently the executing processor load control.

According to the sixth aspect of the invention, the execution sequence of a plurality of signal processing processes is determined according to the information about the connections among the plurality of signal processing modules. According to this novel constitution, the execution sequence of the plurality of signal processing modules can be automatically determined according to user-specified connections, thereby allowing the user to specify connections without having to consider the sequence of signal processing modules.

According to the seventh aspect of the invention, the control program prepares the predetermined number of buffers. A plurality of tone generating programs carry out predetermined signal processing based on a tone signal stored at least one buffer. The result of this signal processing is added to at least one of the predetermined number of buffers. According to this novel constitution, buffer sharing by the plurality of tone generating programs can be implemented. Further, with a processor having cache memory, a high cache hit ratio can be expected with the shared buffers.

While the preferred embodiments of the present invention have been described using specific terms, such description is for illustrative purposes only, and it is to be understood that changes and variations may be made without departing from the spirit or scope of the appended claims.

What is claimed is:

1. A method of synthesizing a musical tone signal by causing a processor to execute a control program and a plurality of music programs, wherein the plurality of music programs are selectively registered by an operation of a user for use in the synthesizing of the musical tone signal, wherein the control program is executed to perform the steps of:

periodically preparing buffer memories, each of which has a capacity of storing plural samples of the musical tone signal;

periodically commanding the processor to start execution of the registered music programs in a predetermined sequence; and after the execution of the music programs, outputting the musical tone signal stored in at least one of the buffer memories, and wherein the registered music programs are executed to perform the steps of:

processing the plural samples of the musical tone signal in response to the commanding step;

controlling a volume of the plural samples of the musical tone signal which is outputted by the processing step; and accumulating the plural samples of the musical tone signal having the controlled volume into at least one of the buffer memories.

2. A method of synthesizing a musical tone signal according to claim 1, wherein said outputting step outputs the musical tone signal stored in at least one of the buffer memories such that one sample is outputted at one sampling period.

3. A method of synthesizing a musical tone signal according to claim 1, wherein the buffer memories are shared by the music programs according to a sequence of the execution of the music programs.

4. A method of synthesizing a musical tone signal according to claim 1, wherein the music programs are executed sequentially.

5. A method of synthesizing a musical tone signal according to claim 1, wherein the control program is executed to perform further the steps of:

receiving MIDI signal;

determining a music program among the plurality of the music programs; and delivering the MIDI signal to the determined music program, and wherein the processing step by the determined music program processes the plural samples of the musical tone signal according to the delivered MIDI signal.

6. A method of synthesizing a musical tone signal according to claim 1, wherein the music programs include at least one tone generating program, which is executed for generating the plural samples of the musical tone signal.

7. A method of synthesizing a musical tone signal according to claim 6, wherein the music programs include a plurality of tone generating programs for generating a plurality of music tone signals.

8. A method of synthesizing a musical tone signal according to claim 7, wherein the tone generating programs include a flexible tone generating program capable of altering a mode of generating a musical tone signal.

9. A method of synthesizing a musical tone signal according to claim 8, wherein the flexible tone generating program alters the mode in terms of a sampling frequency, at which the flexible tone generating program generates a sample of the musical tone signal.

10. A method of synthesizing a musical tone signal according to claim 8, wherein the flexible tone generating program alters the mode in terms of a computation amount, which is consumed to generate a musical tone signal.

11. A method of synthesizing a musical tone signal according to claim 7, wherein the tone generating programs include:

a flexible tone generating program capable of altering a mode of generating a musical tone signal; and an inflexible tone generating program not capable of altering a mode of generating a musical tone signal, and wherein in response to the commanding step, the inflexible tone generating program is executed before the flexible tone generating program is executed.

12. A method of synthesizing a musical tone signal according to claim 11, further comprising the step of controlling the flexible tone generating program to alter the mode of generating the musical tone signal dependently on a working load of the processor after the inflexible tone generating program has been executed in precedence to the flexible tone generating program.

13. A method of synthesizing a musical tone signal according to claim 7, wherein the plurality of the musical tone signals are generated to form a plurality of musical parts, and wherein the control program is executed to perform further the step of setting each of the tone generating programs correspondingly to each of the musical parts.

14. A method of synthesizing a musical tone signal according to claim 7, wherein the tone generating programs contain a first tone generating program capable of generating a musical tone signal by a first computation amount, and a second tone generating program capable of generating a musical tone signal by a second computation amount smaller than the first computation amount, and wherein in response to the commanding step, the first tone generating program is executed in precedence to the second tone generating program.

15. A method of synthesizing a musical tone signal according to claim 6, wherein the tone generating program is executed to generate the musical tone signal as a tone generator selected from an FM tone generator, a PCM tone generator, and a physical model tone generator.

16. A method of synthesizing a musical tone signal according to claim 6, wherein the tone generating program is executed to sequentially generate samples of the musical tone signal in a practical number suitable for processing of the musical tone signal.

17. A method of synthesizing a musical tone signal according to claim 1, wherein the music programs include at least one effect imparting program, which is executed for imparting sound effect to the plural samples of the musical tone signal.

18. A method of synthesizing a musical tone signal according to claim 17, wherein the music programs include more than one effect imparting program.

19. A method of synthesizing a musical tone signal according to claim 18, further comprising the steps of designating connections among a plurality of effect imparting programs, and determining a sequence in the execution of the plurality of the effect imparting programs according to the designated connections, wherein, in response to the commanding step, the effect imparting programs are executed in the determined sequence.

20. A method of synthesizing a musical tone signal according to claim 17, wherein the effect imparting program imparts a sound effect selected from a reverberation effect and a chorus effect.

21. A method of synthesizing a musical tone signal according to claim 17, wherein the effect imparting program uses at least one buffer memory as an input buffer, and wherein said effect imparting program is executed to impart a sound effect to the plural samples stored in the input buffer.

22. A method of synthesizing a musical tone signal according to claim 1, wherein the music programs contain one or more tone generating program for generating the musical tone signal of plural musical parts and at least one effect imparting program for imparting a sound effect to the musical tone signal, and wherein the control program is executed to perform further the step of setting the effect imparting program as one of a system effect for the plural musical parts and an insertion effect for one musical part among the plural musical parts, wherein when the effect imparting program is set as the system effect, the effect imparting program uses at least one buffer memory as an input buffer, and said effect imparting program is executed to impart the system effect to the plural samples stored in the input buffer, and when the effect imparting program is set as the insertion effect, the musical tone signal of one musical part generated by the tone generating program is directly fed to the effect imparting program and the effect imparting program is executed to impart the insertion effect to the fed musical tone signal.

23. A machine readable medium for use in a music apparatus having a CPU, the medium containing a control program and a plurality of music programs executable by the CPU for causing the music apparatus to synthesize a musical tone signal, wherein the plurality of music programs are selectively registered by an operation of a user for use in the synthesizing of the musical tone signal, wherein the control program is executed to perform the steps of:

periodically preparing buffer memories, each of which has a capacity of storing plural samples of the musical tone signal;

periodically commanding the CPU to start execution of the registered music programs in a predetermined sequence; and after the execution of the music programs, outputting the musical tone signal stored in at least one of the buffer memories, and wherein the registered music programs are executed to perform the steps of:

processing the plural samples of the musical tone signal in response to the commanding step;

controlling a volume of the plural samples of the musical tone signal which is outputted by the processing step; and accumulating the plural samples of the musical tone signal having the controlled volume into at least one of the buffer memories.

24. A music apparatus for synthesizing a musical tone signal comprising a processor, a control module, a plurality of music modules, and a multiple of buffer memories, wherein the plurality of music modules are selectively registered by an operation of a user for use in the synthesizing of the musical tone signal, wherein the control module is operated by the processor to perform the steps of:

periodically setting the buffer memories such that each of the buffer memories has a capacity of storing plural samples of the musical tone signal;

periodically commanding the processor to start execution of the registered music modules in a predetermined sequence; and after the execution of the music modules, outputting the musical tone signal stored in at least one of the buffer memories, and wherein the registered music modules are operated to perform the steps of:

processing the plural samples of the musical tone signal in response to the commanding step;

controlling a volume of the plural samples of the musical tone signal which is outputted by the processing step; and accumulating the plural samples of the musical tone signal having the controlled volume into at least one of the buffer memories.

* * * * *